US005787998A

United States Patent [19]

O'Hanlon et al.

[11] Patent Number: 5,787,998

[45] Date of Patent: Aug. 4, 1998

[54] DOWN HOLE PRESSURE INTENSIFIER AND DRILLING ASSEMBLY AND METHOD

[75] Inventors: Thomas A. O'Hanlon, Tacoma; Douglas P. Kelley, Redmond; Scott D. Veenhuizen, Kent, all of Wash.

[73] Assignee: FlowDril Corporation, Kent, Wash.

[21] Appl. No.: 675,934

[22] Filed: Aug. 1, 1996

Related U.S. Application Data

[60] Provisional application No. 60/001,859 Aug. 3, 1995 and provisional application No. 60/010,849 Jan. 30, 1996.

[51] Int. Cl.[6] ..... E21B 7/18

[52] U.S. Cl. ..... 175/67; 175/324

[58] Field of Search ..... 175/67, 317, 324, 175/93; 299/17

[56] References Cited

U.S. PATENT DOCUMENTS 4,921,306 5/1990 Tomlin ..... 299/17
5,246,080 9/1993 Horvei et al. ..... 175/324 X

FOREIGN PATENT DOCUMENTS 2575792 7/1986 France ..... 175/67

*Primary Examiner*—David J. Bagnell
*Attorney, Agent, or Firm*—Robert B. Hughes; Hughes, Multer & Schacht

[57] ABSTRACT

A jet assisted drill system which uses a high pressure intensifier, positioned in a down hole drill assembly. Drill fluid from a drill stem is directed into the drill assembly, and in one mode this drill fluid is passed through the pressure intensifier to cause a piston assembly of the intensifier to reciprocate, with high pressure pistons of the piston assembly delivering high pressure drill fluid to a discharge jet in the drill bit assembly. The lower pressure fluid which drives the low pressure pistons is discharged into a downstream annular passageway and to the drill bit assembly. In a by-pass mode, a selector valve directs drill fluid from an upstream main passageway portion directly to a downstream main passageway portion to pass out the drill bit assembly. This flushes out debris which is carried upwardly out of the drill hole. There is a control valve to operate the piston assembly and a trigger valve operated by the piston assembly to direct fluids selectively to the control valve.

40 Claims, 20 Drawing Sheets

328
324
320
326
316
322
329
298
300
308
314
48
318
302
310
304
312
323
311
306
13B
13B 322
323
300
329
48
306
308

380
382
384
442
396b
388b
400
392b
398b
444
434
394
436
440
430
420
426
418
392a
402
396a
398a
404
388a
400
404
440
442
436
438
422
414
408
410
390
406
416
412
415
416
412
415
390
406
408
410
442
396c
392c
398c
446
388c
400
414
424
440
386
418
428
432

DOWN HOLE PRESSURE INTENSIFIER AND DRILLING ASSEMBLY AND METHOD

CROSS REFERENCE TO RELATED APPLICATIONS

This application claims the benefit of the priority date of U.S. Provisional Application 60/001,859, filed Aug. 3, 1995, entitled "DOWN HOLE PRESSURE INTENSIFIER AND DRILLING ASSEMBLY", and also claims the benefit of the priority date of U.S. Provisional Patent Application 60/010,849, filed Jan. 30, 1996, entitled "DOWN HOLE PRESSURE INTENSIFIER AND DRILLING ASSEMBLY AND METHOD".

BACKGROUND OF THE INVENTION a) Field of the Invention

The present invention relates to a method and apparatus for drilling in an earth strata, and particularly for drilling oil and gas wells. More specifically, the present invention relates to a pressure intensifier and drilling assembly having a down hole pump to provide for jet assisted drilling.

b) Background Art

In the drilling of deep holes, such as in drilling oil and gas wells, it has long been recognized that the rate of penetration can sometimes be substantially enhanced by using a high pressure (15,000 PSI or greater) jet assisted drilling, particularly where the rock strata is harder or more difficult to drill. One prior art method to accomplish this is to provide the drill stem with an inner concentric tube in which very high pressure fluid is transmitted from a surface location downwardly through the inner tube to flow out one or more high pressure jet openings. Then the drill mud at lower pressure is transmitted through the annular passageway between the drill casing and the inner high pressure tube, with the drill mud flushing out the debris in the hole being drilled and carrying this to the surface in an upward flow path between the drill casing and the wall of the hole being drilled.

Because of the problems related to directing the ultra high pressure fluid in the center pipe over long distances which occur when deep wells are being drilled, it has been proposed in the past to use the drill fluid itself to drive a pressure intensifier pump to provide the very high pressure fluid for the jet cutting at the location of the lower end of the drill stem. This approach also involves a number of technical challenges, with regard to designing and arrange of the apparatus to accomplish this task efficiently and reliably, and also have the apparatus fit within the confined space of the drill hole.

The present invention is directed toward providing such a drill assembly where jet assisted drilling is accomplished by a pressure intensifier at a down hole location, and providing the drill assembly with a combination of features which effectively address the problems such as those noted above. Also the present invention can be used for other down hole applications, such as scouring, perforating, and stimulating oil and gas wells, or used in other environments having similar problems.

SUMMARY OF THE INVENTION

In the apparatus and method of the present invention, there is a pump and drilling assembly for drilling into an earth formation. This assembly comprises an elongate housing structure having a longitudinal axis, an upstream end adapted to be connected to a drill string and to receive drill fluid therefrom, and also a downstream end. The housing comprises a tubular outer housing and an inner housing positioned within the outer housing.

There is a drill bit assembly connected to the downstream end of the housing structure. This drill bit assembly has a high pressure fluid jet discharge means.

There is a pressure intensifier means positioned in the inner housing. This pressure intensifier comprises low pressure piston means mounted for reciprocating motion in low pressure chamber means within the inner housing. There is also high pressure piston means connected to the low pressure piston means and mounted for reciprocating motion in high pressure chamber means within the inner housing.

There is a longitudinally extending main fluid passageway means having an inlet end at an upstream location to receive fluid flow of the drill fluid from the drill stem, and an outlet end at a downstream location. At least a portion of the main fluid passageway means is adjacent to the pressure intensifier means and positioned between the inner housing and the outer housing. The main fluid passageway means has an upstream passageway portion and a downstream passageway portion.

A valve section means is positioned in the housing structure between the upstream and downstream ends. The valve section means comprises a control valve means to receive fluid flow from the upstream passageway portion and selectively direct the fluid flow to the low pressure chamber means to cause the low pressure piston means to reciprocate and cause the high pressure piston means to reciprocate. The control valve means directs fluid from the low pressure chamber means to the downstream passageway portion.

There is provided pressure intensifier valve and passageway means arranged to direct low pressure drill fluid into the high pressure chamber means and to direct higher pressure drill fluid from the high pressure chamber means to the high pressure fluid jet discharge means.

In the preferred form, the assembly comprises a selector valve means operatively connected between the upstream passageway portion and the downstream passageway portion of the main fluid passageway means. The selector valve means has a first position where the drill fluid is permitted to pass from the upstream passageway portion of the main fluid passageway means to the downstream portion of the main fluid passageway means in a path by-passing the pressure intensifier means. The selector valve means also has a second position where drill fluid from the upper passageway portion is caused to flow through the control valve means and thence back to the downstream passageway portion to cause the pressure intensifier means to operate.

The selector valve means is responsive to volumetric flow of drill fluid through the upstream passageway portion to move between its first and second position. The selector valve means comprises means to define a by-pass passageway leading from the upstream passageway portion to the downstream passageway portion, and a selector valve element having a first position where the by-pass passageway is open, and a second position closing the by-pass passageway. Spring means urges the selective valve element toward its first open position, and the valve element is responsive to volumetric flow of the drill fluid from the upstream passageway portion to be urged against the spring means to move the selector valve element to the second position.

In two embodiments of the selector valve means there is a pressure relief mechanism responsive to a pressure in the drill fluid from the upstream passageway portion higher than a predetermined level to open the pressure relief mechanism to permit flow from the upstream passageway portion to the downstream passageway portion.

In the configuration of the pressure intensifier means, the low pressure piston means comprises first and second low pressure pistons, positioned in first and second low pressure chamber sections, respectively, with each low pressure piston separating its related chamber section into first and second chamber section portions. The valve section is positioned adjacent to the low pressure chamber means and has a first valve passageway leading from the control valve means to one of the first chamber section portions and a second valve passageway leading to one of said second chamber section portions. The control valve is arranged to direct fluid from the upstream passageway portion alternately to the first and second valve passageways, and to withdraw fluid from the second and first chamber section portions alternately.

In a preferred configuration, the valve section comprises a valve section housing positioned between the first and second low pressure pistons which are interconnected by a piston rod extending through the valve section housing. The piston rod is mounted in the valve section housing for reciprocating movement in sealing relationship with the valve section housing. The first valve passageway leads from the control valve means to one side of the valve section housing to communicate with one of first chamber section portions, and the second valve passageway leads from the control valve to an opposite side of the valve section housing to communicate with the one of said second chamber section portions.

The piston rod has first rod passageway means extending longitudinally and opening to both of the first chamber section portions. There is also a second rod passageway means extending longitudinally in the piston rod and opening to both of the second chamber section portions. In the preferred form, the piston rod comprises a tubular inner rod member and a tubular outer rod member. The first rod passageway means is a passageway within the inner rod member, and the second rod passageway means is an annular passageway between the inner rod member and the outer rod member.

In the configuration shown herein, the high pressure piston means comprises two high pressure pistons. The two high pressure pistons, the two low pressure pistons, and the piston rod comprise a piston assembly. There is tension rod means extending through the piston rod to the two high pressure pistons. There are means interconnecting with the ends of the tension rod means to place a tension load on the tension rod means to apply a compressive load through the high pressure pistons and into the piston rod.

In a preferred embodiment, there is at least a third low pressure piston positioned in a third low pressure chamber section. The third low pressure piston is connected by a piston rod section to the second low pressure piston. The piston rod section has first and second additional rod passageway means interconnecting with the first and second rod passageway means of the piston rods, to cause the first and second chamber section portions of the third piston to communicate with the first and second valve passageways.

The valve section further comprises pilot valve means operatively connected to the control valve means to direct fluid pressure against pressure control surface means of the control valve means to cause the control valve means to move between the first and second positions. The pilot valve means has actuating members positioned at first and second chamber section portions on opposite sides of the valve housing. Each of the actuating members is responsive to operative engagement of an adjacent one of the low pressure piston in a manner that when the low pressure piston comes into operative engagement with its related actuating member, the pilot valve means move to its other position. This causes the pilot valve means to move the control valve means from one of its first and second positions to the other of its first and second positions.

The actuating members and the pilot valve means are arranged relative to the two low pressure piston in a manner that when either of the two low pressure piston engages one of the actuating members to shift the pilot valve means, the low pressure piston has not come into engagement with the valve section housing.

At least one of the upstream passageway portion and the downstream passageway portion of the main fluid passageway means comprises an annular passageway portion defined by the outer housing and the inner housing. The valve section housing has an outer housing portion blocking said annular passageway. In the preferred form, both of the upstream passageway portion and the downstream passageway portion of the main fluid passageway means comprise an annular passageway, with the valve housing having an outer housing portion separating the two annular passageways from one another.

The present invention further comprises filter means which has a first filter surface located adjacent to the upstream passageway portion so as to be in contact with drill fluid in the upstream passageway portion. The filter means has a second surface adjacent to a filter chamber. The filter means is arranged so that drill fluid flowing into the inlet end of the main fluid passageway means has portion thereof directed through the filter means into the filter chamber. The pressure intensifier valve and passageway means comprises inlet passageway means leading from the filter chamber to inlet means of the high pressure piston means. Thus filtered drill fluid passes into the high pressure chamber means and is delivered to the high pressure jet discharge means.

Also, the control valve means has control fluid passageway means leading from the filter chamber to pressure operating surface means of the control valve means.

Further, in a preferred form, the control valve passageway means interconnecting the control valve passageway means with the filter chamber connects with the pilot valve means, and the pilot valve means interconnects with the pressure operating surface means of the control valve. The control valve means and the pilot valve means have discharge passageway means leading to a location outside of the outer housing, so that the drill fluid from the filter chamber that is directed to the control valve means and the pilot valve means is discharged to a location outside of the outer housing.

In a preferred configuration, the filter means comprises a planar filter screen means having a substantial alignment component parallel to an adjacent flow path of drill fluid passing through the upstream passageway portion. This is accomplished so that the drill mud in the upstream passageway portion has a substantial flow path component parallel to the filter screen means, so that the drill fluid passing adjacent to the filter screen means and through the upstream passageway portion removes filtered particles from the filter screen means. In a specific preferred configuration, the portion of the upstream passageway portion adjacent to the filter screen means is an annular passageway portion, and the filter screen means extends in a curved configuration inside of the annular passageway portion.

Also, there is a second filter means positioned upstream of the filter means. The second filter means is a more coarse filter means and the filter means is a finer filter means.

In a preferred configuration of the control valve means, there is a valve housing having a longitudinal axis and defining chamber means comprising an inlet first chamber section to receive fluid flow from the upstream passageway portion, and an outlet second chamber section to deliver fluid to the downstream passageway portion.

There is a longitudinally aligned valve element mounted for reciprocating movement in the chamber means.

The valve housing has at the first chamber section a first fluid inlet port and two first fluid outlet ports on opposite sides of the first fluid inlet port. The first fluid inlet port has a predetermined axial dimension.

The valve element has a first spool mounted in the first chamber section for reciprocating movement across the first fluid inlet port. The first spool member has an axial dimension less than the axial dimension of the first inlet port in a manner that when the first spool element is centrally positioned relative to the first inlet port, there is fluid flow from the first inlet port to both of said first outlet ports.

The valve housing has at the second chamber a second fluid outlet port and two second fluid inlet ports on opposite sides of the second fluid outlet port. The second fluid outlet port has a predetermined axial dimension.

There is a second spool element mounted for reciprocating motion in the second chamber section. The second spool element has an axial dimension less than the axial dimension of the second outlet port, in a manner that when the second spool element is centered in the second outlet port, the second outlet port communicates with both the second inlet ports.

The effect of this is that each spool element has an intermediate position where fluid flow from the first inlet port is divided to the first outlet ports, and fluid flow from the second inlet ports flows simultaneously through the second outlet ports.

In a preferred form, each of the first inlet port and second outlet port has axial end portions having a transverse dimension which increases in a direction toward a center portion of the first inlet port and the second outlet port.

There is a high pressure downstream passageway leading from the high pressure chamber means to the high pressure fluid jet discharge means, this high pressure downstream passageway having check valve means positioned therein. This prevents reverse flow from entering into the high pressure fluid jet discharge means. Also, the high pressure downstream passageway has an additional filter to prevent particles or debris flowing into the high pressure downstream passageway and through the high pressure fluid jet discharge means.

Also, in the assembly of the present invention, there is a force transmitting means positioned at one of a downstream end and an upstream end of the inner housing, and arranged to transmit a compression load along said inner housing, and to react said load into an adjacent one of a downstream end portion and an upstream end portion of the outer housing. Thus, the compression load is reacted in the inner housing to the other end portion of the inner housing and into the other end portion of the outer housing.

The pressure intensifier means comprises a pressure intensifier housing defining the low pressure means and the high pressure means. The pressure intensifier housing comprises a portion of the inner housing, with other components of the inner housing being axially aligned with the pressure intensifier housing. Thus, the force transmitting means places the pressure intensifier housing and the other components axially aligned therewith into compressive loading. In a preferred form, the force transmitting means comprises a mounting block engaging the outer housing, and a bearing member engaging an adjacent portion of the inner housing. The force transmitting means comprises axially adjustable force transmitting means which can be moved in an axial direction to press against the bearing member from the mounting block and thus impart the compression load to the inner housing.

In a preferred configuration, the mounting block comprises an annular block member, and the bearing member is an annular bearing member. The block member and the bearing member define a portion of a through passageway through which drill fluid can pass.

In the preferred form, the force transmitting means is located at the downstream end portions of the inner housing and outer housing. The drill bit assembly is removably mounted at the downstream end of the assembly. The adjustable force transmitting means has adjustable head means at a downstream location in the force transmitting means. Thus, the operating head means are accessible from a downstream location with the drill bit assembly removed.

In a specific configuration, the adjustable force transmitting means comprises a plurality of bolt means mounted in the mounting block. The boat means have downstream positioned bolt head means which can be engaged to move the bolt means axially against the bearing member.

In the method of the present invention, the drill bit assembly is provided as described above. The drill fluid passes into the main fluid passageway means, and in the operating mode is directed through the control valve to the pressure intensifier means to pressurize a portion of the drill fluid to a very high pressure and direct this to the jet discharge nozzle of the drill bit assembly. To by-pass the pressure intensifier means, the fluid pressure in the upstream passageway portion is lowered to cause the selector to move to its bypass position to direct the flow from the upstream passageway portion directly into the downstream passageway portion to flow to the drill bit assembly. The drill fluid that passes through the low pressure chamber or which passes directly from the upstream passageway portion to the downstream passageway portion flows to the drill bit assembly to pass into the hole being drilled to flush debris from the hole being drilled.

Other features will become apparent from the following detailed description

DESCRIPTION OF THE PREFERRED EMBODIMENT

A. General Description of the Present Invention

Figure 1:
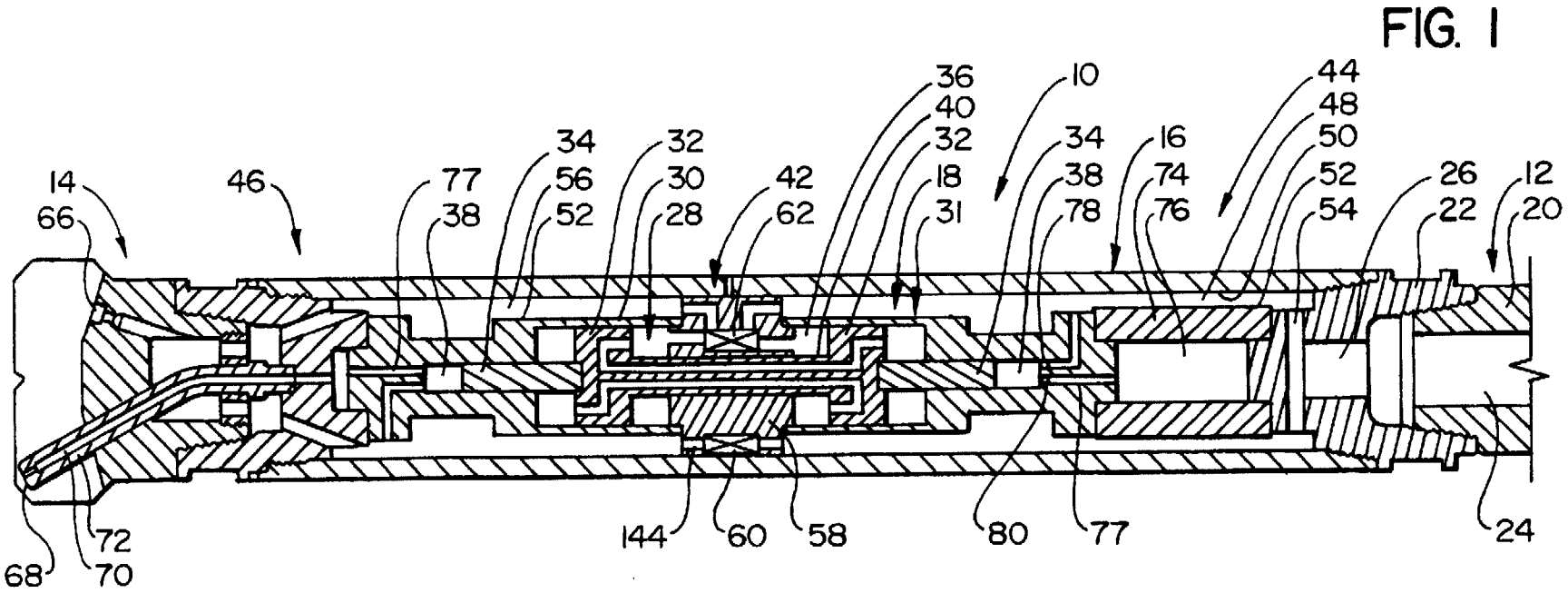
FIG. 1 is a semi-schematic longitudinal sectional view of the first embodiment of the present invention.

The pump and drilling assembly 10 of the present invention is shown somewhat schematically in FIG. 1. This assembly 10 comprises a drill stem (only the lower end of which is shown at 12 in FIG. 1), a drill bit assembly 14, an outer tubular housing 16 extending between and connecting the drill stem 12 with the drill bit assembly 14, and a pressure intensifier section or system 18 positioned in the housing 16.

The overall configuration of the pump and drilling assembly 10 is that of an elongate cylinder of relatively small diameter. The drill stem 12 delivers drilling mud into the pressure intensifier system 18. The intensifier section 18 has an operating mode and a non-operating mode. In the operating mode, the intensifier section 18 receives the drilling mud at a moderately high pressure (e.g. 3,000 PSI) and utilizes this mud to raise the pressure of a relatively small portion of this drilling mud to a relatively high pressure (e.g. 20,000 to 50,000 PSI). This very high pressure drilling mud is in turn delivered to the drill bit assembly to be emitted as very high pressure fluid jets that assist in the drilling operation. The remaining larger portion of the mud is delivered to the drill bit assembly and is discharged through a flush nozzle or nozzles to perform its usual function of flushing out the various rock fragments and debris that have been removed in the drilling operation. These fragments and debris are carried by the mud upwardly in the annular space between the housing 16 and the bore hole and further upwardly around the drill stem to the surface.

In the non-operating mode of the intensifier section 18, the intensifier section 18 is bypassed. The drilling mud flows out the drill bit assembly 14 and upwardly through the annular space between the bore hole and the drill stem 12.

The drill stem 12 is, or may be, of conventional design, and as shown herein the lower end 20 of the bottom end of the lowermost section of the drill stem 12 is threadedly connected to a stem adapter 22. The drill stem has a central through flow passage 24 which leads to a passage 26 in the adapter 22 to deliver the drilling mud into the upper end of the intensifier section 18.

The drill bit assembly 14 is, or may be, of conventional design, and would commonly have cutters (not shown for convenience of illustration) on its operating face. The entire drill stem 12 is rotated to cause the cutters to travel a rotary path to engage and remove the rock or other material that is being drilled. In the non-operating mode of the intensifier section, these cutters operate unassisted by the ultra-high pressure cutting jets. In the operating mode of the intensifier section 18, the ultra-high pressure jets assist the cutters to enhance the drilling operation.

In the following description, the term "upper" or "upward" shall denote proximity to, or a direction toward the stem adapter 22 and drill stem 12, while the term "lower" or "downward" shall denote a direction toward or proximity to the drill bit assembly 14. Also, the term "upstream" shall denote proximity to the upper end of the assembly 10, while the term "downstream" shall denote proximity to the drill bit assembly 14.

The design of the present invention uniquely solves a number of critical challenges or problems. It must be recognized that in many drilling operations, the drill stem 12 could extend several miles into the earth strata, and the remoteness of the pumping and drilling assembly 10 from the above ground control location magnifies the usual operating problems. First, there is the problem of reliability and durability. If the pressure intensifier 18 in the drilling assembly 10 becomes damaged or nonfunctional so that it must be withdrawn up to the surface location for repair, this can be extremely costly.

Another significant problem is that the drilling mud which is commonly used in a drilling operation (this drilling mud usually comprising a carrier fluid with small particles suspended therein) is highly abrasive. As will be disclosed later in this description, in addition to performing its usual function of clearing out the debris that is being drilled and raising it to the surface, the drilling mud is used in the present invention not only as the fluid that forms the ultra-high pressure jet, but is also used as the lower pressure operating fluid in the high pressure intensifier section. This results in a number of challenges in designing the systems to minimize the effect of the abrasion that could result from the drill mud.

Yet another consideration is the configuration and sizing of the assembly 10. For the ultra-high pressure liquid jet cutting to be effective, it is necessary not only to raise the pressure to a relatively high level (e.g. 20,000 to 50,000 PSI), but also to provide the ultra-high pressure jet cutting fluid at a sufficiently high volumetric rate.

The manner in which the present invention solves these various problems will be discussed in more detail as we continue through the description of the invention.

With further reference to FIG. 1, the pressure intensifier section 18 comprises a piston assembly 28 and a pump housing 30 in which the piston assembly 28 reciprocates. The piston assembly 28 comprises a central portion 31 comprising a plurality of low pressure pistons 32, each having a relatively large diameter, and two ultra-high pressure plungers 34 positioned on opposite ends of the central section 31 comprising the lower pressure pistons 32. The pump housing 30 has a central larger diameter chamber 36 in which the larger pistons 32 reciprocate. At opposite ends of the central chamber 36 are smaller diameter ultra-high pressure chambers 38 in which the respective plungers 34 reciprocate.

In the schematic drawing of FIG. 1, there are shown only two low pressure pistons 32. These two pistons 32 are connected by a center rod 40. As will be disclosed later, there can be three or four low pressure pistons or more. Where there are more than two low pressure pistons 32, there are additional rods or rod sections interconnecting each adjacent pair of low pressure pistons 32.

Positioned within the outer housing 16 at a location between the two low pressure pistons 32 is a valve section 42. This valve section 42 separates the assembly 10 into an upstream section 44 and a downstream section 46. In the upstream section 44, there is an outer annular upstream passage 48 defined by the inner surface 50 of the outer tubular housing 16, and the outer surface 52 of the pump housing 30. The pressurized drilling mud received from the drill stem 12 and the stem adapter 22 flows through the passageways 24 and 26 and through a passageway schematically shown at 54 into the annular passageway 48 to flow to the valve section 42. The manner in which this flow through the passage 54 is (for convenience of illustration) indicated only schematically in FIG. 1, but will be described more fully later in this text where a filter system and other components will be described.

The downstream section 46 has (in a manner similar to the upstream section 44) an annular passageway 56 defined by the downstream inner surface portion 50 of the outer housing 16 and the downstream outer surface portion 52 of the pump housing 30. This downstream annular passageway 56 receives drilling mud from the valve section 42 and delivers this mud in a downstream direction.

The valve section 42 comprises a valve housing 58 which fits against the inner surface 50 of the outer main housing 16 to form a seal at this surface 50. Mounted within the valve housing 50 is a selector valve 60 and a control valve 62. In addition to the valves 60 and 62, there is mounted in the valve housing 58 a trigger valve 64 (not shown in FIG. 1, but shown in other drawings herein and later described herein) which operates in response to the back and forth movement of the piston assembly 28 to cause the proper shifting of the control valve 62.

Figure 1A:
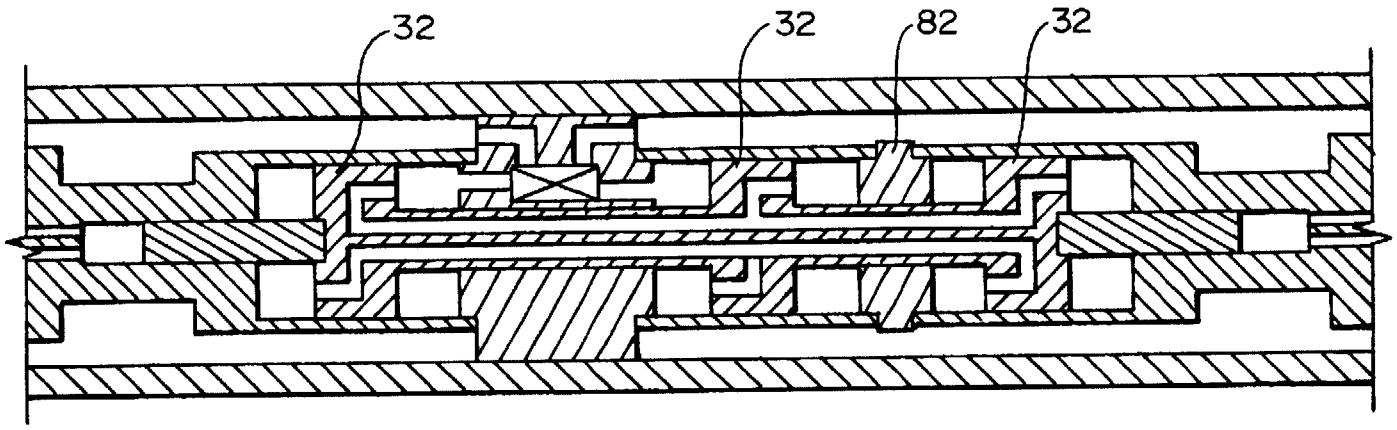
FIG. 1A is a view similar to FIG. 1 showing a second embodiment, but only showing the central portion of the apparatus.
Figure 1B:
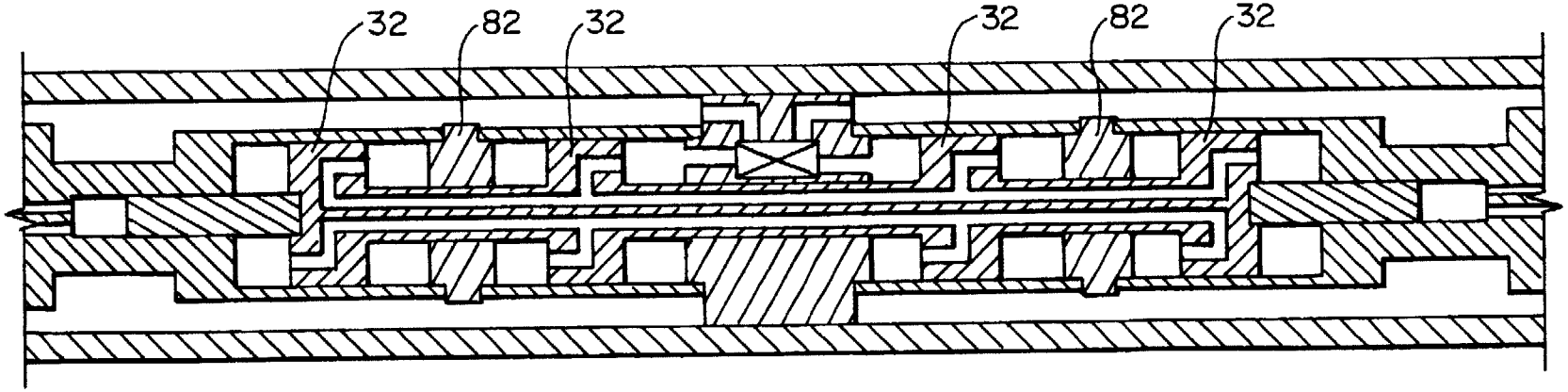
FIG. 1B is a third embodiment, and as in FIG. 1A only shows the central portion thereof.
Figure 1C:
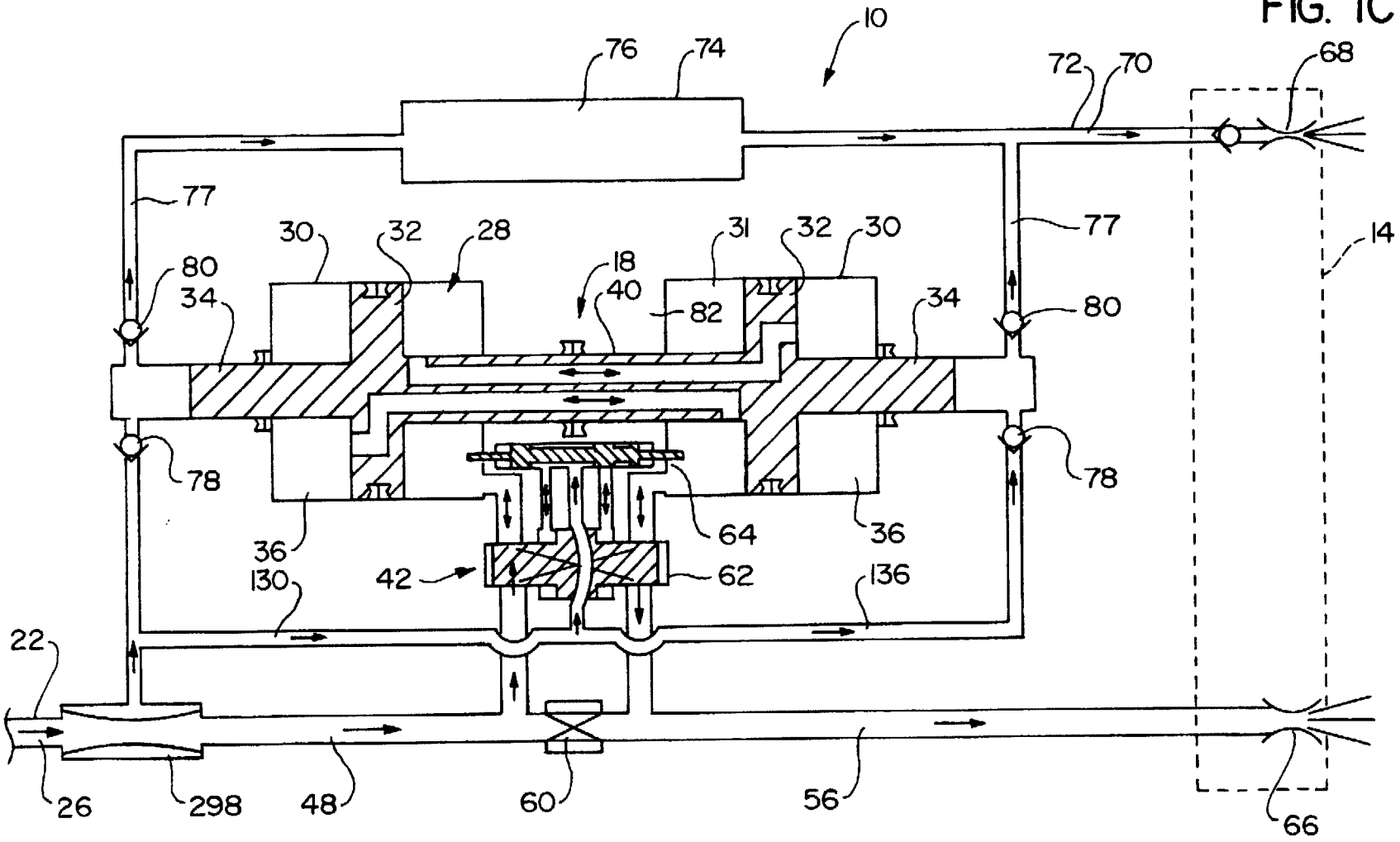
FIG. 1C is a simplified flow circuit diagram of the main components of the present invention.

It is believed a clearer understanding of the operation of the present invention will be obtained by referring also to FIG. 1C which is a simplified diagram of the main components showing more clearly the flow patterns in the assembly 10.

As mentioned previously herein, the selector valve 60 has two operating modes, namely a by-pass mode and a pumping mode. In the by-pass mode, the selector valve 60 permits the flow of drill mud from the upstream annular passageway 48 through the outlet passageway 144 of the selector valve 60 directly into the downstream annular passageway 56 from which the drill mud flows into the drill bit assembly 14. This drill mud then flows out the flush nozzle or nozzles 66 to perform the usual function of the drill mud of flushing the fragments and debris from the drill surface of the ground strata and carry these upwardly in the annular space between the surrounding surface of the drill hole and the outer surface of the drill stem 12 and housing 16. There is also one or more ultra-high pressure discharge nozzles 68, through which the very ultra-high pressure fluid from the intensifier section 18 is received in the pumping mode. However, in this by-pass mode, little or no fluid is discharged from the one or more high pressure nozzles 68.

When the selector valve 60 is in the pumping mode of operation, the pressurized drilling mud from the drill stem 12 is directed into sections of the central chamber 36 in an alternating fashion (due to the action of the control valve 62) to cause the piston assembly 28 to reciprocate back and forth. This reciprocating motion of the piston assembly 28, causes each of the plungers 34 to reciprocate sequentially on an intake stroke and discharge stroke to supply a portion of the drill fluid (i.e. drill mud) at ultra-high pressures to flow to the drill bit assembly 14 to pass into a passageway 70 defined by an ultra-high pressure discharge tube 72 that in turn delivers the ultra-high pressure jet through the ultra-high pressure nozzle or nozzles 68.

There is provided at the upstream end of the pumping system 18 an ultra-high pressure attenuator 74 which receives the outflow from the upstream and downstream ultra-high pressure chambers 38. The chamber 76 of the attenuator 74 connects with both of the discharge passageways 77 leading from the high pressure chambers 38 via a tubing (not shown in FIG. 1 but shown and described later herein) to provide a more constant ultra-high pressure flow to the nozzle or nozzles 68. The two ultra-high pressure chambers 38 are each provided with an inlet check valve 78 and an outlet check valve 80 connected to a related outlet tube 77 to accomplish the proper inlet and outlet flows from each ultra-high pressure chamber 38.

As indicated above, there can be three, four or more low pressure pistons 32 to increase the total force exerted on the piston assembly 28 to cause its reciprocating motion, without increasing the diameter of the pumping system 18. FIG. 1A shows only the pumping section of the assembly 10, with the modification that there are three low pressure pistons 32 instead of two low pressure pistons 32, as shown in FIG. 1. The third low pressure piston 32 is simply added onto one side of the upstream low pressure piston 32 and there is a stationary partition 82 separating the chamber portions between the two upstream low pressure pistons 32.

In FIG. 1B, there is shown another embodiment of the assembly 10 of FIG. 1, where there are four low pressure pistons 32, two of the pistons 32 being positioned upstream of the central valve section 42 and two of these pistons 32 at a downstream location from the valve section 42. Another partition 82 is added on the downstream side to separate the chamber portions between the two downstream low pressure pistons 32. FIG. 1C shows a simplified diagram of the major mechanical components, and their relationships in the overall fluid flow schematic.

It is to be understood that FIGS. 1, 1A, 1B and 1C are rather schematic and are intended to describe the main components of the present invention in a simplified form.

To complete the general description of the overall apparatus, reference is now made to FIGS. 2, 3, 4 and 5 which are somewhat schematic and illustrate in sequence one half cycle of the back and forth reciprocating motion of the piston assembly 28. There will now be a further description of the apparatus, and then the mode of operation will be discussed in the following section with further reference to FIGS. 2–5. It should be noted that in FIGS. 2 through 5, the upstream and downstream locations are reversed relative to FIGS. 1, 1A, and 1B. Accordingly, the upstream side in FIGS. 2 through 5 is at the left hand of FIGS. 2–5, and the downstream side at the right side of FIGS. 2–5. Also, FIGS. 2–5 shows three low pressure pistons 32, as illustrated in FIG. 1A.

It will be noted that in FIGS. 2–5 the control valve 62 has been shown more completely than in FIG. 1 (but still somewhat schematically). More specifically, it can be seen that the control valve 62 comprises a reciprocating valve element 84 which comprises a central piston 86 and end spools 88, each of which is connected by a rod 90 to the central piston 86. The upstream annular passageway 48 leads into an upstream inlet port 92, and the downstream annular passageway 56 leads from a downstream outlet port 94. (The control valve 62 is shown in more detail in FIGS. 10, 12A, 12B and 12C, and will be described more fully later herein.)

For convenience of description, the three low pressure pistons 32 will be designated (by reading left to right in FIGS. 2 through 5) 32*a*, 32*b*, and 32*c*. Also, the low pressure chamber 36 will be considered as being separated into three chamber portions 36*a*, 36*b* and 36*c*, each having positioned therein a related one of the pistons 32*a*, 32*b* and 32*c*, respectively. Further, each chamber portion 36*a*, 36*b* and 36*c* shall be considered as having an upstream chamber portion 96*a*, *b* and *c*, respectively, and a downstream chamber portion 98*a*, *b* and *c*, respectively.

Figure 2:
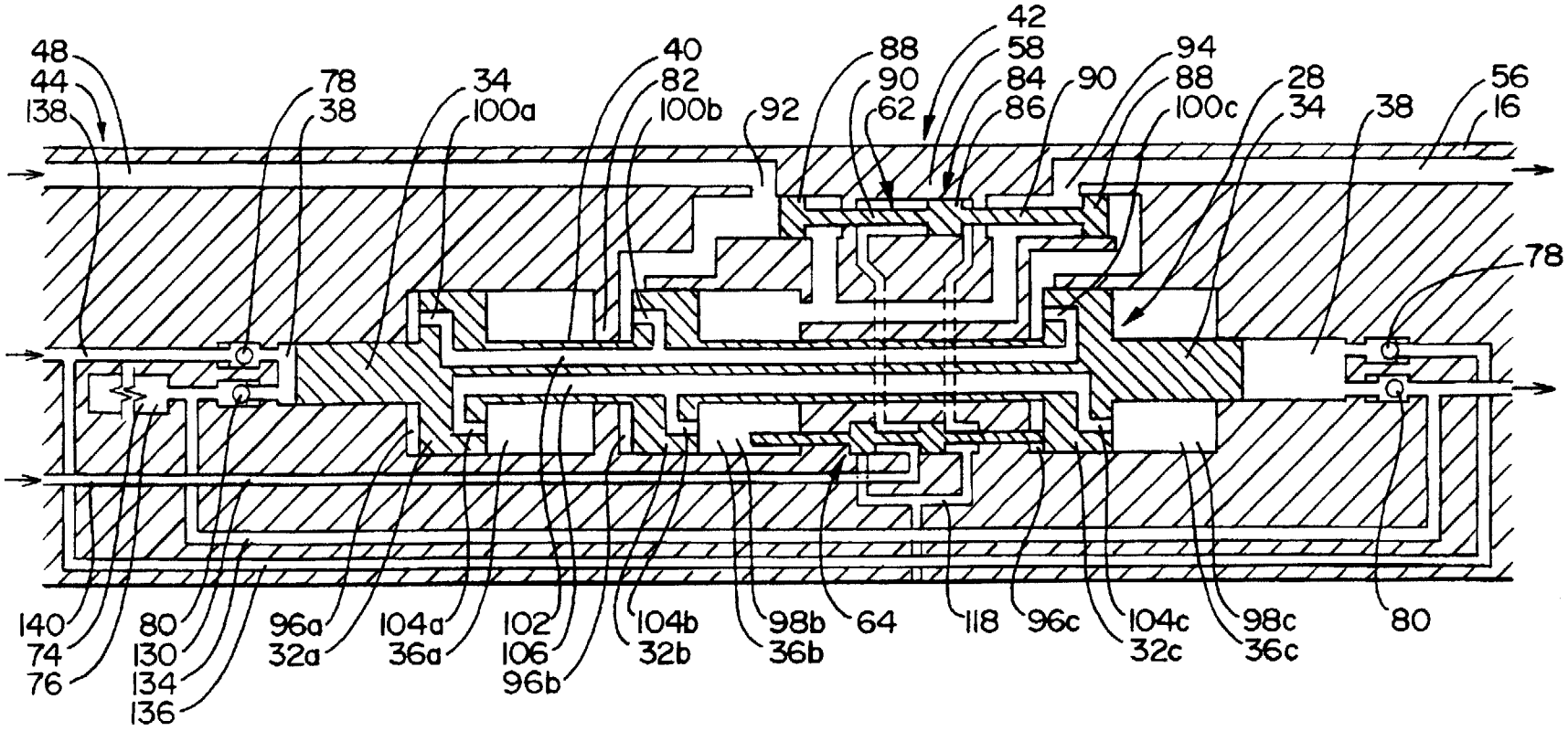
FIGS. 2 through 5 are semi-schematic drawings, which show in sequence the operating cycle of the present invention, these showing only the central portion of the apparatus of the second embodiment of FIG. 1A.

With the valve element 84 in the right hand position as shown in FIG. 2, the port 92 connects to a left hand chamber portion 96*b* which is upstream of the low pressure piston 32*b*. Also, it will be noted that the outlet port 94 connects to a chamber portion 98*b* which is between the piston 32*b* and the valve section 42.

It will be noted that each of the upstream chamber portions 96*a*, 96*b* and 96*c*, are interconnected with one another through a related port 100*a*, 100*b* and 100*c*, respectively, all of which connect to a central passageway 102 extending the length of the connecting rod 40. Thus, it can be recognized that when the drill mud from the upstream section 44 passes through the annular passageway 48, through the port 92 and into the chamber portion 96*b*, it also flows into the port 100*b*, through the passageway 102 and out the ports 100*a* and 100*c* into the other two chamber sections 96*a* and 96*c*, respectively.

In like manner, each piston 32*a*, *b* and *c* has a second port 104*a*, 104*b* and 104*c*, respectively, with each of these ports being interconnected by another passageway 106 also extending through the center rod 40, thus interconnecting the downstream chamber portions 98*a*, *b* and *c*.

In FIGS. 2 through 5, for convenience of illustration, the selector valve 60 is not shown. On the other hand, the aforementioned trigger valve 64 is shown somewhat schematically. For clarity of illustration in the Figures, the components of the trigger valve will not be given numerical designations in FIG. 2, but these numerical designations will be indicated in FIG. 3.

The trigger valve 64 comprises a trigger valve element 108 having two spools 110 and 112. Extending laterally outwardly from each spool 110 and 112 are first and second trigger fingers 114 and 116, with the left trigger finger 114 extending into the chamber 98*b*, and the other trigger finger 116 extending into the chamber 96*c*. There is a fluid outlet line 118 which leads from two ports 120 and 122 positioned at the end locations of travel of, respectively, the spool elements 110 and 112, respectively and discharges to a location outside the outer housing 16. The trigger valve 64 has its valve chamber 123 connecting to either of two outlet lines 124 and 126 which connect to ported locations on opposite sides of a central valve chamber 128 of the control valve 62. Also, there is an inlet passageway 130 which leads from an upstream location to direct filtered drilling mud to a central inlet port 132 at the middle of the trigger valve chamber 123.

The two outlet check valves 80 are interconnected with one another through the passageway 134, and this passageway 134 also connects to the attenuator 74. The two inlet check valves 78 connect with one another through a line 136. The flow into this line 136 is from the line 138 that in turn connects to the filtered inflow of the upstream drill fluid.

Figure 15A:
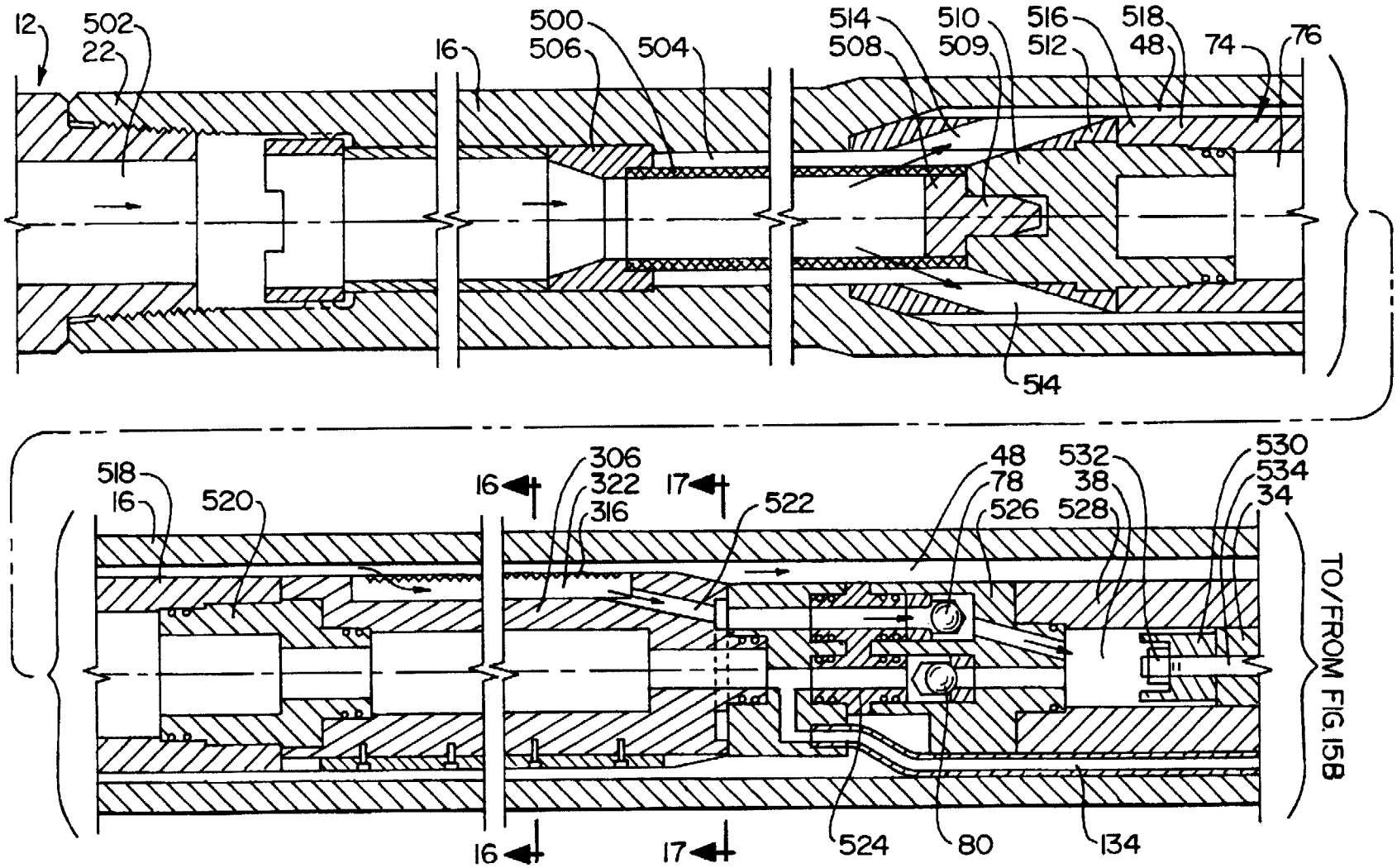
FIGS. 15A, 15B and 15C are longitudinal sectional views showing, respectively, an end portion, a middle portion, and an opposite end portion of the apparatus of the present invention, this being shown in more detail.

As will be described later herein, at a further upstream location of the inlet 138, there is provided between the drill stem adapter 22 and the pumping section 18 a filtering section, where there is a first filter of a larger mesh size and a second downstream filter having a finer mesh size. (These are shown in FIG. 15A and will be described more fully later herein.) The major part of the drill fluid passes only through the first filter and thence downstream through the upstream annular passageway 48. The drill fluid that passes through the second filter flows through the tube 138 to flow into the upstream located inlet check valve 78 and also through the passageway 136 to the other inlet check valve 78. Thus, a portion of the twice filtered drill fluid is part of that portion of the drill fluid which is pressurized to an ultra-high pressure level to flow through the ultra-high pressure nozzle or nozzles 68.

Also, the twice filtered drill fluid is directed into the inlet 140 to flow to the passageway 130 to the center port of the trigger valve 64.

Figure 6A:
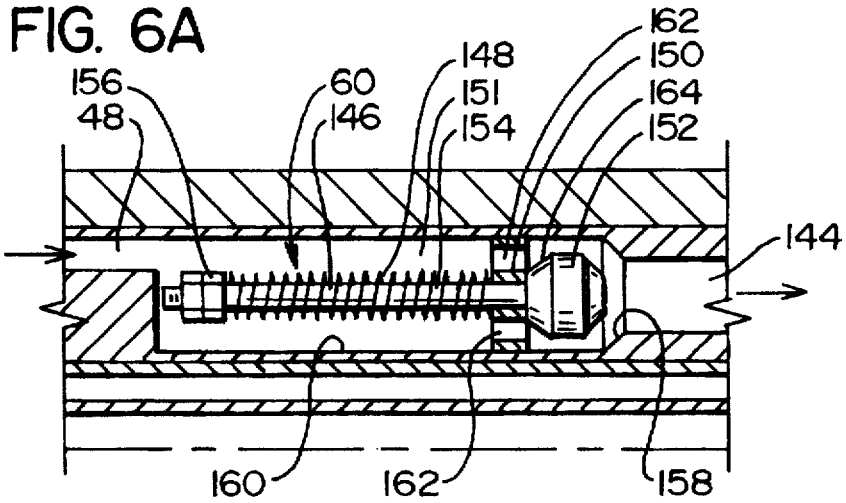
FIGS. 6A and 6B are longitudinal views, partly in section, of the selector valve in two different operating modes.
Figure 6B:
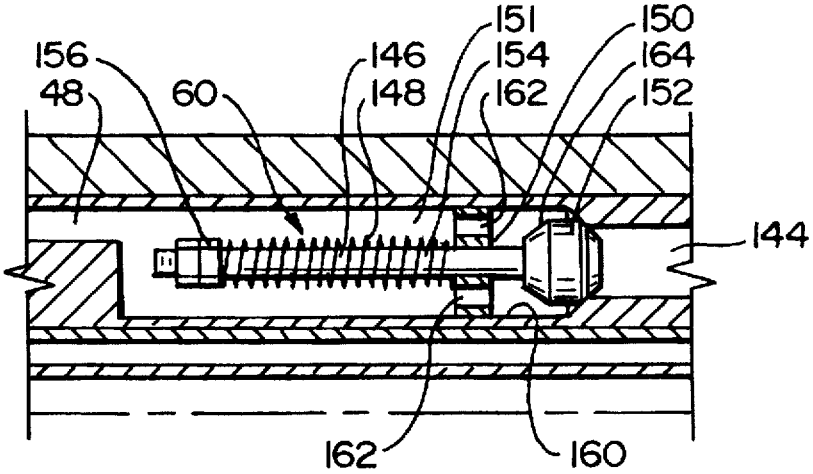

To complete this section of the overall general description of the assembly 10, reference is now made to FIG. 6A and 6B, which illustrate a presently preferred embodiment of the selector valve 60. FIG. 6A shows the valve 60 in the bypass mode where the drilling mud flows through the upstream annular passageway 48 through the valve 60 and out a passageway 144 leading to the downstream annular passageway 56. FIG. 6B shows the selector valve 60 in its operating mode where it blocks the outlet passageway 144. In this position, the main flow of drilling mud is compelled to flow through the control valve 62 and through the intensifier section 18 to cause the ultra-high pressure drilling fluid to flow outwardly from the jet nozzles 68.

The selector valve 60 comprises a valve element 146, a positioning spring 148 and a mounting member 150 that positions the valve element 146 in a longitudinally aligned position in the valve chamber 151. The valve element 146 comprises a plug element 152 which is connected to an elongate cylindrical valve stem 154 slideably mounted in the mounting member. A spring abutment member 156 (shown herein as a pair of nuts threaded against each other in locking engagement) is threaded onto the upstream end of the valve stem 154. The positioning spring 148 is a compression spring that bears against the aforementioned mounting element 150 at one end and against the abutment member 156 at the other end. Thus, the valve element 146 is urged by the spring 148 to its by-pass position shown in FIG. 6A where the valve element 146 is spaced away from the valve seat 158. The mounting member 150 engages the inwardly facing surface 160 that defines the valve chamber 151, and this member 150 has a plurality of through openings 162 to permit the flow of the drill mud through the mounting member 150.

As indicated previously herein, the selector valve 60 is responsive to the volumetric flow rate of the drilling mud flowing through the drill stem 12. In the by-pass mode, the volumetric flow of drill mud is at a sufficiently high pressure so that the drill mud is able to perform its usual function of flushing out the fragmented rock and other debris from the end of the bore hole and move the same upwardly in the annular space between the bore hole and the stem 12. However, the volumetric flow rate and pressure is not great enough to overcome the force of the positioning spring 148 and force the valve element 146 into blocking engagement with the valve seat 158.

To move the selector valve 60 into the operating mode, the volumetric flow rate of the drilling mud moving down the drill stem is raised to a higher level so that the volumetric flow of the drill mud against the upstream surface 164 of the valve plug 152 is sufficiently great to exert a force on the valve element 146 that overcomes the force of the spring 148 to move the valve plug 152 into the blocking position of FIG. 6B. As indicated above, this causes the drilling mud flowing through the outer annular passageway 148 to flow through the pressure intensifier section 18.

B. Overall Description of the Operation of the Present Invention

As indicated previously herein, in addition to referring to the specific drawings mentioned in the following text, it would be helpful to refer also to FIG. 1C which shows the flow pattern more clearly.

Reference is first made to FIG. 1. The drilling operation is started in the usual manner at a surface location where the drill bit assembly 14 is threaded onto the lower end of the tubular housing 16 (containing the pressure intensifier section 18) which in turn is threadedly connected to the stem adapter 22 that connects to the lowermost section of the drill stem 12. Initially, the earth strata through which the drill bit 14 is boring may not be sufficiently hard to warrant the use of the ultra-high pressure liquid jet that would be emitted from the nozzles 68. Accordingly, in this mode, the drill mud is pumped into the passageway 24 of the drill stem 12 at a volumetric rate that is adequate to flush the fragmented material from the bore hole and carry it upwardly around the drill stem 12 to the surface where the fragmented material can be screened out and the drill mud reused. However, the volumetric rate is sufficiently low so that the selector valve 60 remains in its by-pass mode, as shown in FIG. 6A.

In the by-pass mode, the pressure of the drilling mud is sufficiently low so that it either will not cause the piston assembly 28 to reciprocate, or simply reciprocate the piston assembly 28 at such a slow rate that any flow from the ultra-high pressure chambers 38 is at a very low rate (and also at a rather low pressure), so that the flow out the ultra-high pressure nozzles 68 has no cutting effect (or at most a very insignificant cutting effect), with this drill mud that is flowing out the nozzles 68 simply being added to the rest of the drill mud flowing out the flush nozzles 66 to perform the flushing operation. During this by-pass mode, the main flow of the drill mud is from the drill stem through the upstream annular passageway 48, through the outlet passageway 144 of the selector valve 60, and thence directly into the downstream annular passageway 56 to flow outwardly through the flushing nozzles 66.

When the drill bit assembly 14 reaches an earth strata which is of sufficient hardness to warrant the use of the ultra-high pressured jet assisted cutting, the drill mud pump at the surface location is caused to operate at a higher volumetric flow rate so that the mud flowing through the selector valve 60 moves the selector valve 60 from the position of FIG. 6A to the position of FIG. 6B to close off the flow through the selector valve 60. This causes the entire flow through the upstream annular passageway 48 to be directed through the control valve 62 and into the high pressure intensifier section 18.

Reference will now be made to FIGS. 2–5 which illustrate the pressure intensifier section 18 at four different stages of its operating mode. As indicated above, in the operating mode the selector valve 60 moves to its closed position of FIG. 6B and remains closed until the time that the volumetric flow rate of the drill mud is lowered to permit the valve 60 to move back to its open position for the by-pass mode. Accordingly, the selector valve is not shown in FIGS. 2–5. Rather, the trigger valve 64 and the control valve 62 are shown somewhat schematically, but in sufficient detail to explain the overall mode of operation of the ultra-high pressure section 18. (Also, it should be kept in mind that the left to right orientation in FIGS. 2–5 is reversed from that shown in FIG. 1, so that in FIGS. 2–5 the upstream end is at the left.)

In FIG. 2, the piston assembly 28 has just completed its travel from a right hand position of FIG. 2 to the left hand position shown in FIG. 2, and the right finger 116 of the trigger valve 64 has already been engaged by the right hand piston 32c to have moved the trigger valve element 108 to its left hand position. This in turn has caused the valve element 84 of the control valve 62 to move to a right hand position, as shown in FIG. 2.

With reference to FIG. 2, with the piston assembly 28, the control valve 62 and the trigger valve 64 in the positions shown in FIG. 2, the piston assembly 28 is now beginning its path of travel in a right hand direction. It is believed that it would be helpful if at this point of the description of the operation, a distinction is made between the main flow of drill mud, which is once filtered, and the flow of the drill mud which is twice filtered. As indicated previously herein, upstream of the pressure intensifier section 18 there is a dual filter system, which will be described later herein.

Stated briefly, there is a first filter through which the drill mud travels to flow directly into the upstream annular passageway 48. Then a portion of the drill mud that flows through the first filter is redirected through a second filter of finer mesh size to provide a flow of twice filtered drill mud. This twice filtered drill mud is directed into the tube inlet 138, and also through the inlet 140 for the tube 130.

The twice filtered mud flowing into the tube 138 is directed to the inlet check valves 78 for the two high pressure chambers 38. Thus, the flow of ultra high pressure liquid (i.e. drill mud) which is discharged from the two outlet check valves 80 and into the interconnecting line 134 which connects to both outlet check valves 80 is also twice filtered drill mud. This line 134 also connects to the chamber 76 of the attenuator 74. Thus, the ultra high pressure drill mud which flows into the ultra high pressure passageway (indicated at 166) and to the ultra high pressure nozzles 68, is drill mud which has been twice filtered.

In addition, the drill mud that flows into the inlet 140 is also twice filtered, and this drill mud is directed into the central port 132 of the trigger valve 64. This flow of twice filtered drill mud which flows into the valve chamber of the trigger valve 64 in turn flows alternately through the passageways 124 or 126 into the central chamber 128 of the control valve 60. It is this flow into this chamber 128 that acts against the central piston 86 of the control spool valve element 84 to cause its reciprocating motion. The outflow from the central chamber 128 of the control valve 62 is back through either of the passageways 124 and 126 (this occurring in an alternating fashion) so that this outflow passes through the outlet tube 118.

Let us now return to FIG. 2 to analyze the operating cycle of the intensifier section 18. As indicated above, in the position of FIG. 2, the control valve 62, the trigger valve 64 and the piston assembly 28 are all positioned so that the piston assembly 28 is beginning its movement from a left hand position to a right hand position. The main flow of drilling mud through the upstream annular passageway 48 (which has been directed only through a coarse filter) passes through the valve port 92 and thence directly into the upstream chamber portion **96*b* of the central chamber portion 36*b*. As indicated previously, the upstream chamber portion 96*b* has a portion of this flow of drill mud which flows into the upstream chamber 96*b* and passes through the port 100*b* into the passageway 102 formed in the rod 40. This passageway 102 in turn communicates with the ports or openings 100*a* and 100*c*, which lead into the chamber portions 96*a* and 96*c*, respectively. The effect of this is that the drilling mud is exerting pressure against the left working surfaces of all three pistons 32*a*, 32*b* and 32*c*. This causes the piston assembly 28** to move to the right.

At the same time, the right hand middle pressure chamber **98*b* communicates with the passageway that leads directly to the outlet port 94, which in turn leads to the downstream annular passageway 56. Also the drilling mud in the chamber portions 98*a* and 98*c* flows through the ports 104*a* and 104*b*, respectively, into the passageway 106 and also out the outlet port 94. As can be seen by looking back at FIG. 1, the flow from the annular passageway 56 flows through passageways 169 in the drill bit assembly 14 and outwardly through the flush nozzles 66. The fluid flowing through the exhaust port 94 is at a substantially lower pressure than the fluid which is flowing through the inlet 92, so that there is sufficient pressure differential to cause each of the three pistons 32*a*, 32*b* and 32*c* to exert a substantial force through the right hand plunger 34 (in viewing FIGS. 2–5) so that the pressure in the then pressurized chamber 38** is as high as, for example, 20,000 to 50,000 PSI.

The highly pressurized drilling mud in the right hand ultra high pressure chamber 38 (viewed in FIGS. 2–5) passes outwardly through its related exit check valve 80 and through the passageway 166 to flow out the ultra-high pressure nozzles 68. At the same time there is an inflow of drill fluid through the inlet check valve 78 of the other chamber 38.

Figure 3:
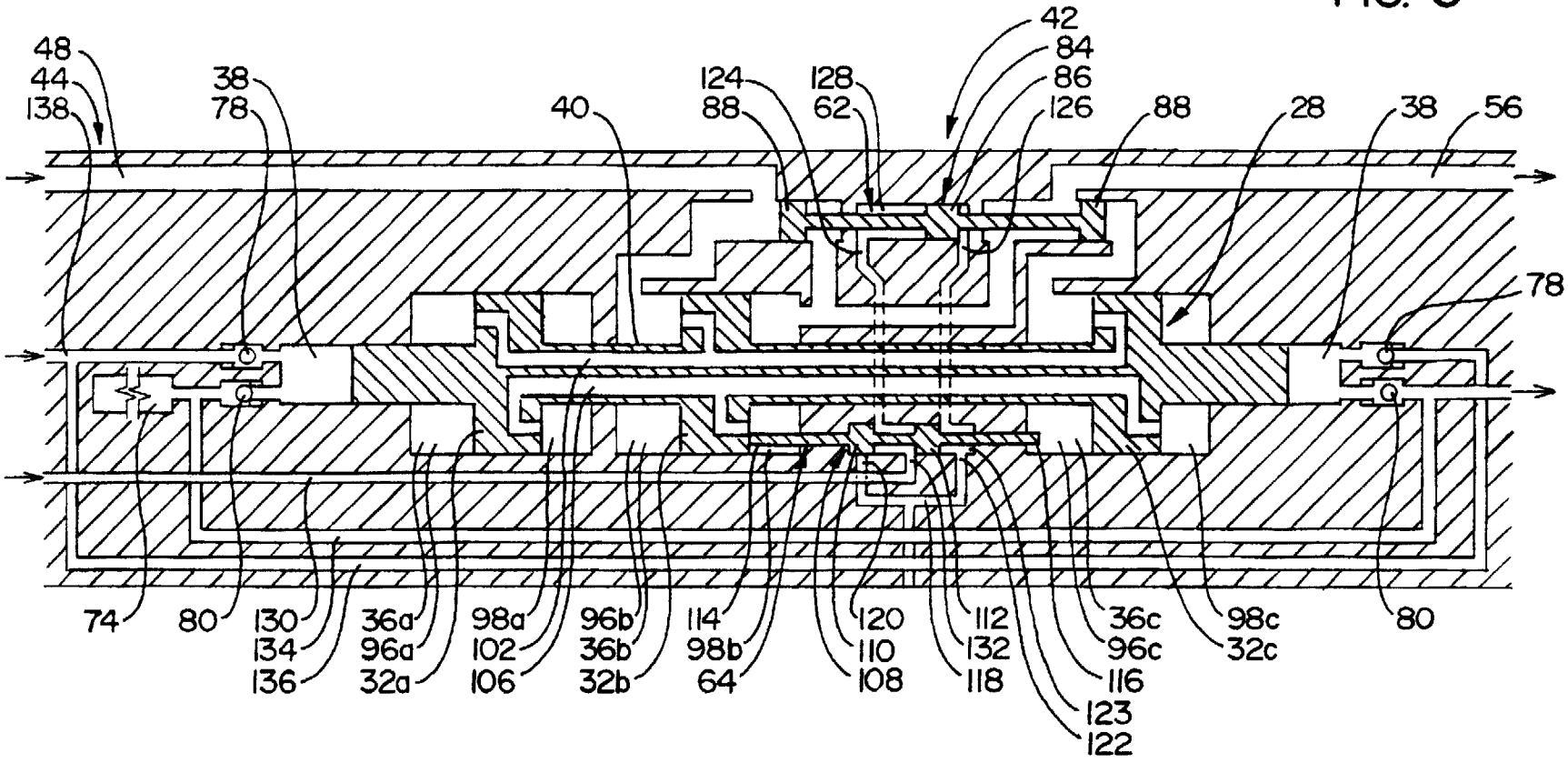

Reference is now made to FIG. 3 which shows the piston assembly 28 at the time it is just moved a little more than half way through its path of travel from left to right. The control valve 62 and the trigger valve 64 each still remain in the same position, and (as indicated earlier) the selector valve 60 remains in the same operating position (i.e. pumping position), as it does throughout the entire operation of the pressure intensifying section 18.

It will be noted that the piston **98*b* is just beginning to engage the left trigger finger 114. The trigger valve 64 is arranged so that it has a snap action. More specifically, the trigger fingers 114 and 116 are each arranged with a compression spring so that it is only after one of the trigger fingers 114 or 116 is depressed so that its end tip is almost to the trigger valve housing, that the spring action built into the trigger valve 64 snaps the valve element 108 lo the opposite side very rapidly to immediately initiate the shifting of the valve element 84 of the control valve 62. (This will be described more fully later herein with reference to FIG. 10**.)

Figure 4:
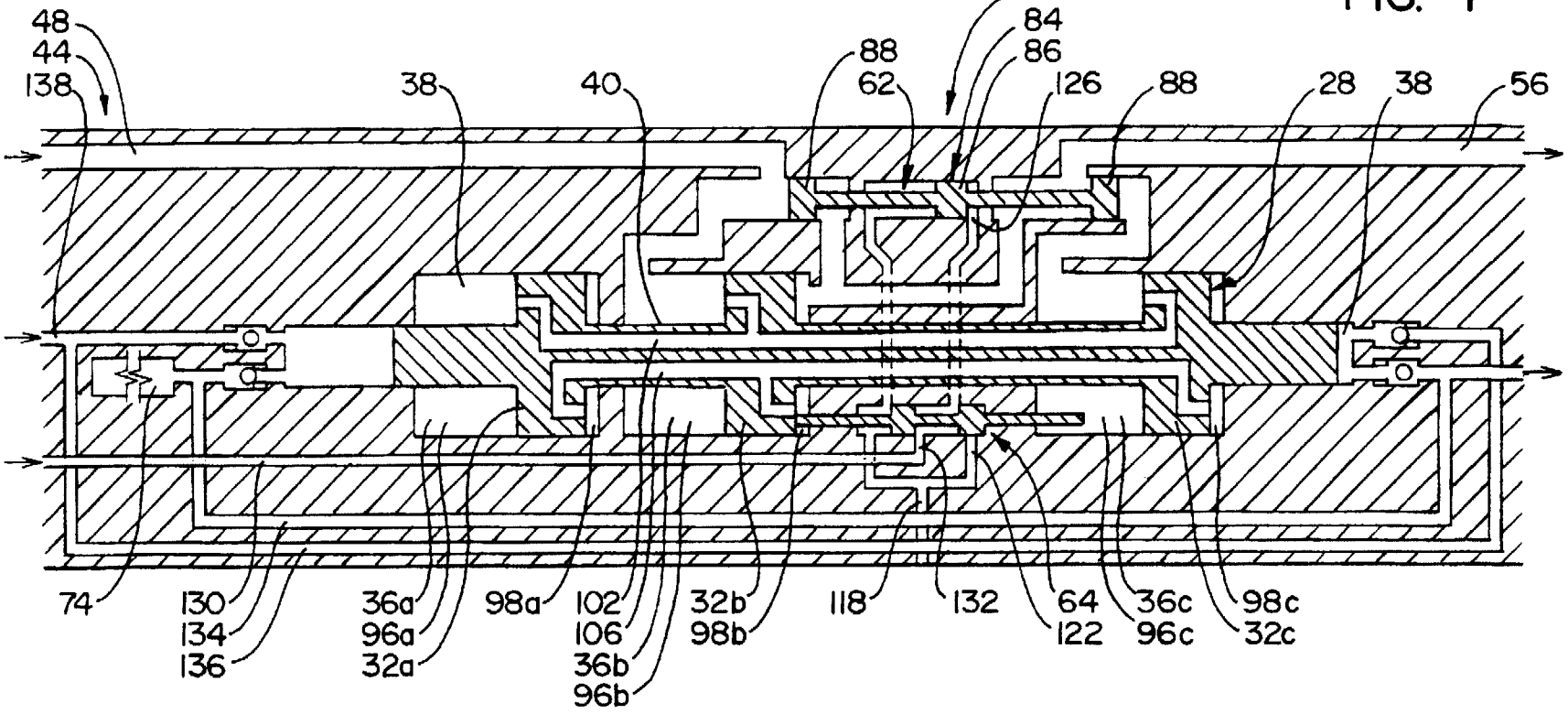

Reference is now made to FIG. 4, which shows the situation where the piston assembly 28 has reached its limit of travel in the right hand direction, and where the valve element 108 of the trigger valve 64 has moved to the right hand position. It can be seen that in the position of FIG. 4, the trigger valve inlet port 132 communicates now with the right chamber 122 of the trigger valve and thus there is a flow of higher pressure fluid through the right control passageway 126 which pressurizes the right surface of the central piston 86 of the valve element 84 of the control valve 60 to cause the control valve element 84 to immediately begin moving to the left.

Figure 5:
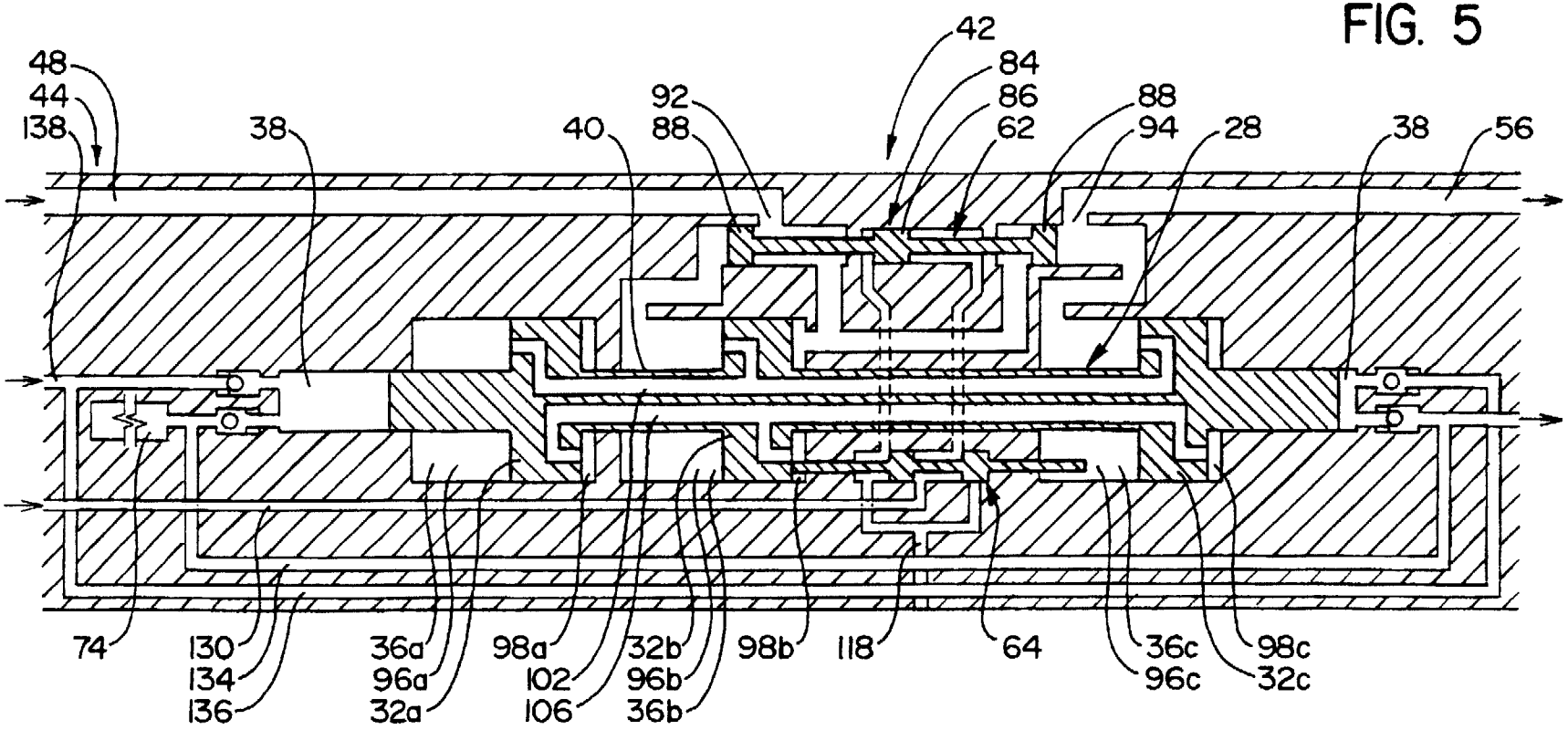

Reference is made of FIG. 5, which shows the situation immediately after the shifting of the valve element 84 of the control valve 60 to the left. A comparison of FIG. 5 with FIG. 2 will promptly reveal that we have substantially the same situation as in FIG. 2, except that the directions of flow into and out of the piston chambers **96*a–c* and 98*a–c* have been reversed. In this instance, the higher pressure fluid flowing through the left annular passageway 48 and into the port 92 now passes into the chamber 98*b* to pressurize that chamber. The flow into the chamber 98*b* in turn flows through the port 104*b* and into the passageway 106 to flow out the ports 104*a* and 104*c* to pressurize the chamber portions 98*a* and 98*c***.

In like manner, it can be seen that the piston chambers **96*a*, 96*b* and 96*c* are now connected to the exhaust port 94. Thus, from the position of FIG. 5, the piston assembly 28 begins a pressure stroke to the left to cause an outflow of ultra high pressure fluid from the left outlet check valve 80, through the passageway 134 and out through the tube 166. At the same time, the right hand inlet check valve 78 opens to permit an inflow of the fluid into the right hand chamber 38 (as seen in FIGS. 2–5**).

As indicated previously, the chamber 76 of the accumulator 74 connects through the passageway 134 with both of the outlet check valves 80. At the very high pressures involved (i.e. 20,000 to 50,000 PSI) the drilling fluid is compressible to some extent. With the rather rapid transition in the trigger valve 64 and the control valve 62, the reverse of flow in the chambers **36*a*, 36*b* and 36*c* is very rapid, and the accumulator 74 is able to thus diminish the effect of any significant drop in the pressure in the ultra high pressurized fluid being discharged from the tube 166**, limiting the drop in pressure to about 10% or less of the average ultra-high pressure discharge pressure.

C. Further Description of the Components of the Present Invention and Modifications Thereof In this section, there will be more detailed descriptions of five of the main components of the present invention and/or modifications of the same. These five main components are:

a. The selector valve 60;

b. the trigger valve 64;

c. the control valve 62;

d. the filter system, and e. the piston assembly 28.

Each of these will be discussed under appropriate headings.

a. The selector valve 60

The selector valve 60 shown in FIGS. 6A and 6B is a more simple version of the selector valve, and in that version, there is not provided a pressure relief mechanism in the valve. Rather, there is provided a pressure relief mechanism at a surface location. Thus, if there is some blockage in, for example, the intensifier section 18, the potential over pressure is alleviated by the opening of a relief valve or the like at the surface location, thus avoiding damage to the assembly 10 or to the drill stem 12 or the drill rig or mud pumps on the surface.

Figure 7A:
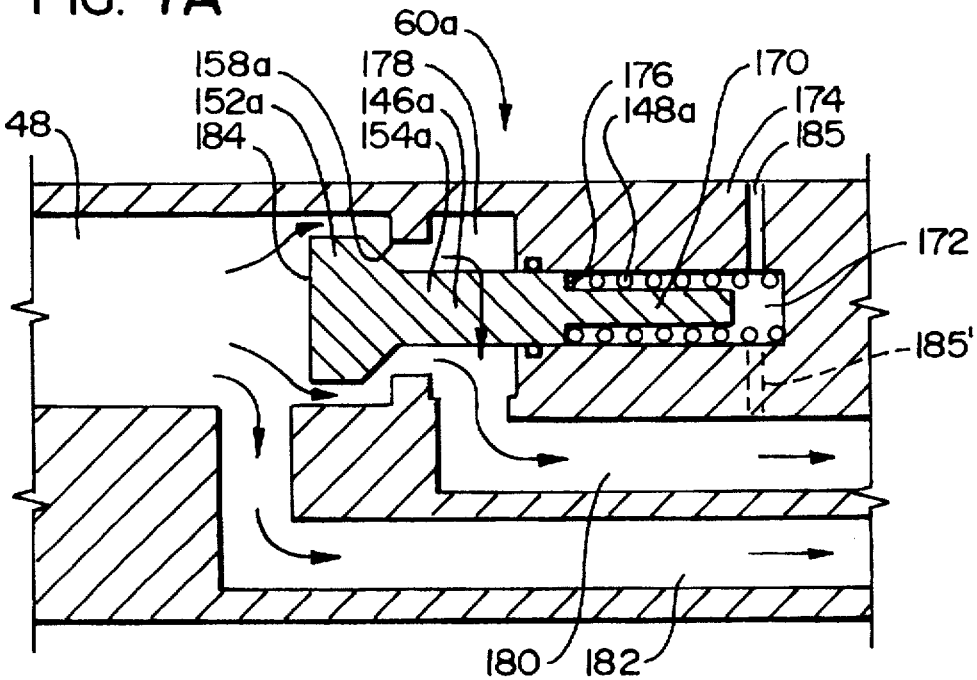
FIGS. 7A and 7B are semi-schematic drawings showing a first modified version of a selector valve in two different operating modes.
Figure 7B:
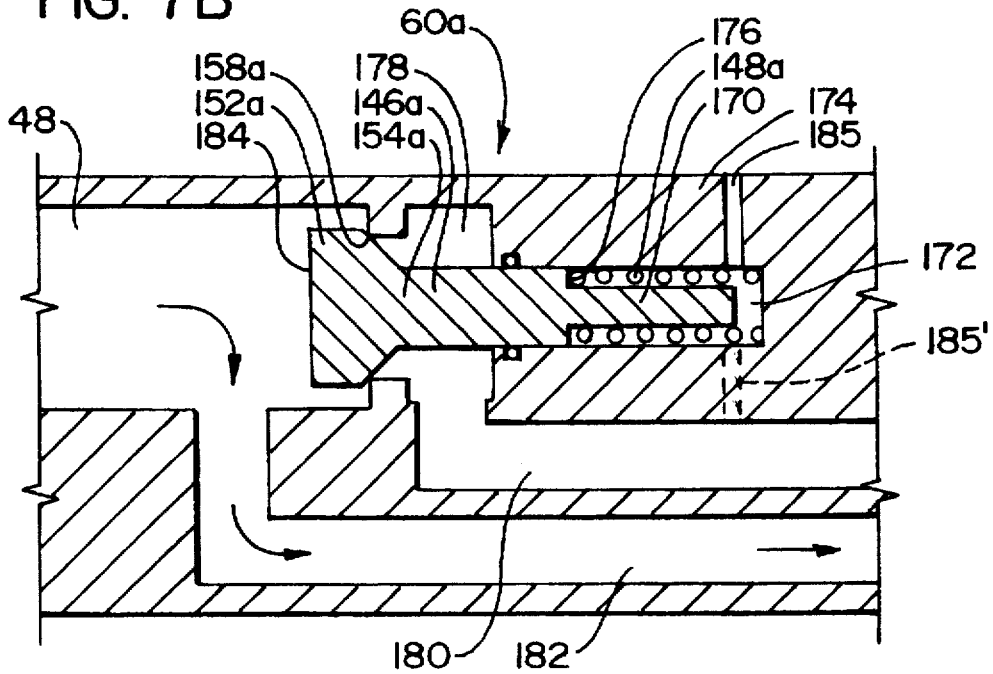
Figure 8A:
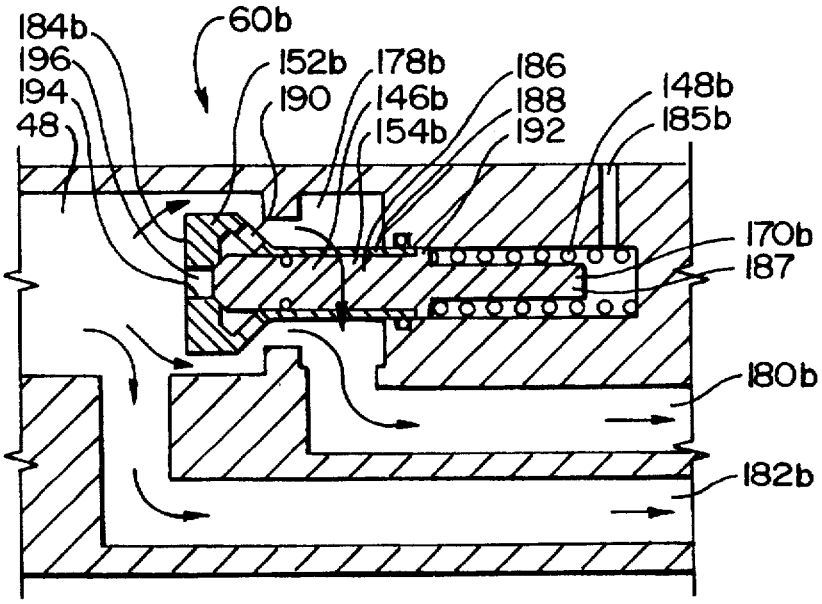
FIGS. 8A, 8B and 8C are three semi-schematic drawings showing a second modified version of the selector valve in three different operating modes.
Figure 9:
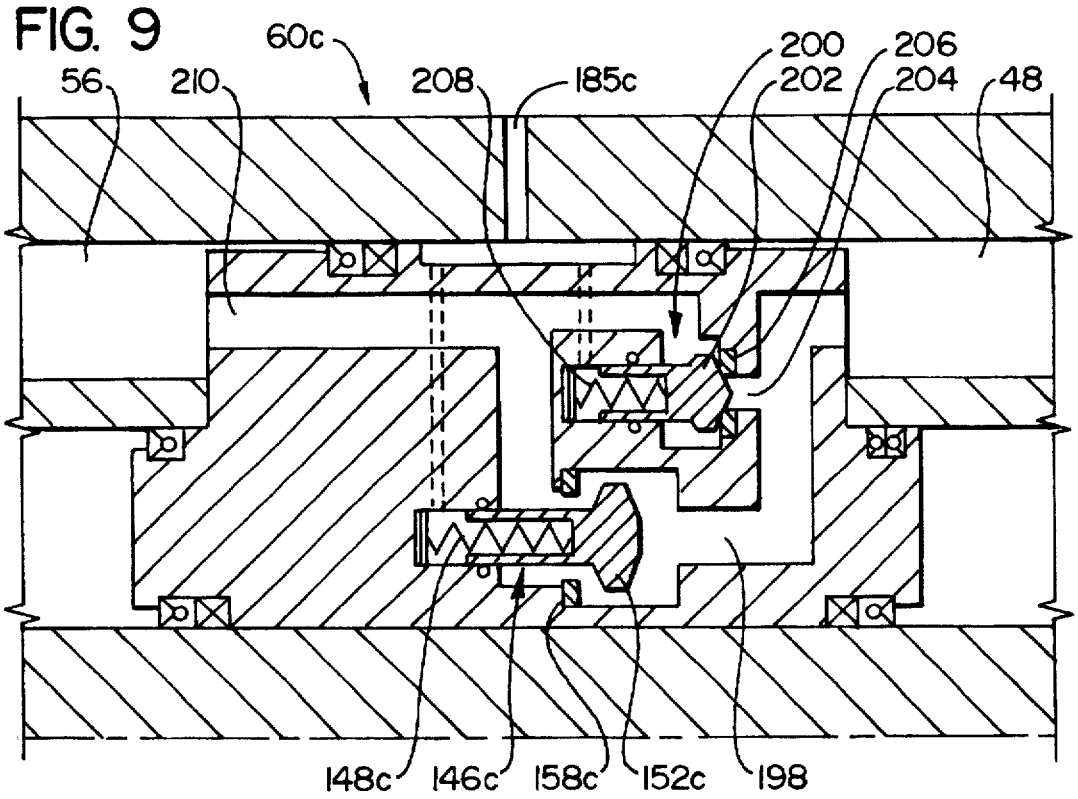
FIG. 9 is a semi-schematic view of a third modified version of the selector valve.

In two of the three alternative selector valve embodiments which are to be described in this sub-section, such a pressure relief mechanism is incorporated in the selector valve itself, this being in the second and third embodiments (shown in FIGS. 8A, B, C, and FIG. 9). This is accomplished in a manner that if there is a blockage in the pressure intensifier section 18, thus creating an increase in back pressure in the drilling mud traveling down the drill stem, this will cause the selector valve to move to a secondary bypass mode so that the pressure intensifier section 18 and other elements upstream are not damaged. In the first alternative selector valve embodiment shown in FIGS. 7A and 7B, the pressure relief valve is at a surface location.

i. The first alternative embodiment of the selector valve (FIGS. 7A and 7B)

This first alternative embodiment 60*a* is shown in FIG. 7A and 7B. Components which are similar to the components of the selector valve shown in FIGS. 6A and 6B will be given like numerical designations, with an "a" suffix distinguishing those of this first alternative embodiment.

Thus, this selector valve 60*a* comprises a valve element 146*a* having a valve plug 152*a* and a valve stem 154*a*. The valve stem 154*a*has a reduced diameter portion 170 which is positioned in a cylindrical recess 172 formed in the valve housing 174.

The compression spring 148*a* is positioned in this chamber 170 so as to bear against an adjacent surface of the housing and to press against a shoulder 176 formed in the stem 154*a*.

It can be seen that in the position of FIG. 7A, the positioning spring 148*a* pushes the valve plug 152*a* to the left so as to be away from the valve seat 158*a*. Thus, the drill mud flows from the upstream annular passageway 48 in a direction around the valve plug 152*a* into a passageway section 178 immediately downstream of the valve plug 152*a* and thence out a passageway 180 into the downstream annular passageway 56.

There is also a passageway 182 which leads into a pressure inlet port for the related control valve 60. In the bypass mode of operation, the volumetric flow through the upstream annular passageway 48 is at a pressure insufficient to cause significant flow through passageway 182 that leads into the control valve 62 and thence into the intensifier section 18.

To describe the operation of the present invention in the operating mode, reference is now made to FIG. 7B. At the surface location, the volumetric flow of the drilling mud is raised so that there is an increase in pressure against the upstream facing surface 184 of the valve plug element 152*a*. This overcomes the force of the positioning spring 148*a* to move the plug 152*a* rearwardly to seat against the valve seat 158*a* and thus block flow through the bypass passageway 180. Thus, all of the flow is directed through the passageway 182 into the control valve 60 so as to cause reciprocation of the piston assembly 128.

It will be noted that there is a vent passageway 185 leading from the enclosed end of the chamber 172. This vent passageway 185 can be vented as shown in FIGS. 7A and 7B to the downstream annular passageway 56. As an alternative, this chamber 172 can be vented to the by-pass passageway 180, and this alternative vent passageway is shown in broken lines in FIG. 7A at 185'. If the passageway 185 leads to the downstream annular passageway 56, the closing force on the valve is controlled by the pressure difference between the pressure in chamber 178 and passage 48 as compared to the pressure in the chamber 172. However, if the vent passageway 185' is used (instead of that at 185) so that it is vented to the passageway 180, the closing force on the valve element 146*a* is controlled by the pressure drop through the passageway around the plug element 152*a* and by the seat 158*a*, which could be adjusted by adjusting the flow rate therethrough.

As indicated above, in this first alternative embodiment, for pressure relief there is also provided at the surface location a pressure relieve mechanism so that the pressure at which the pump at the surface location pumps the drill mud is limited.

ii. The Second Alternative Embodiment of the Selector Valve 60*b*

Figure 8B:
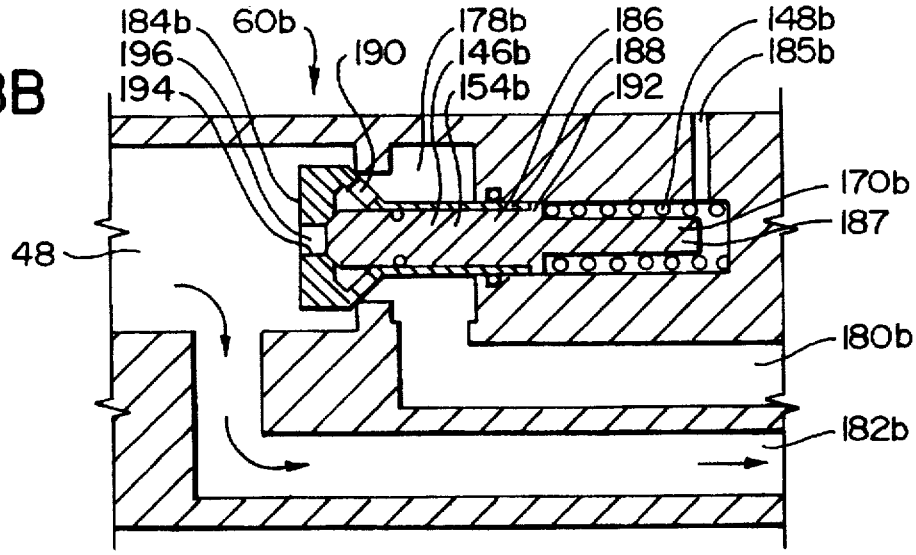
Figure 8C:
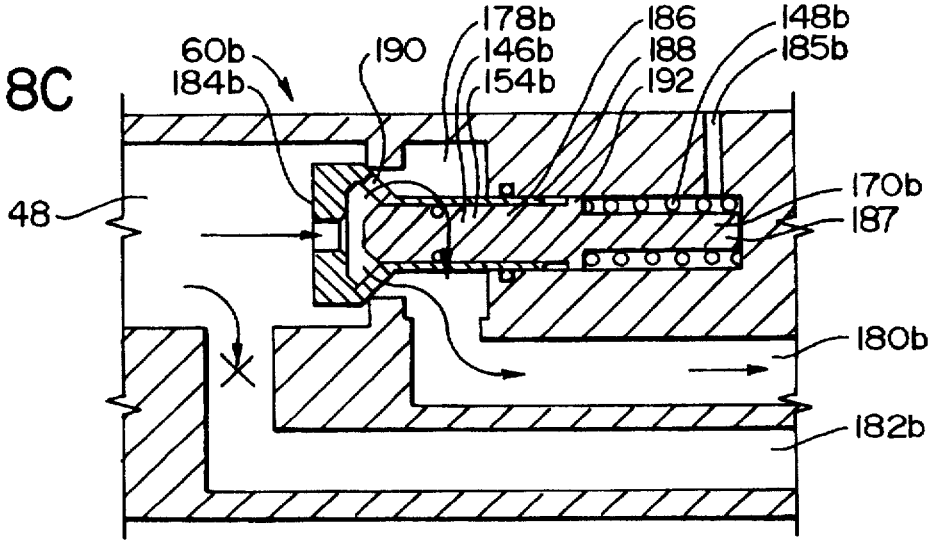

Reference is now made to FIGS. 8A, 8B and 8C which shows the second alternative embodiment 60*b*. This has the same overall configuration as the first alternative embodiment shown in FIGS. 7A and 7B, except that a pressure relief mechanism has been built into the valve element. Components of this second modified embodiment of the selector valves which are similar to those of the prior embodiments will be given like numerical designations, with a "b" suffix distinguishing those of this second modified embodiment.

Thus, the selector valve 60*b* comprises a valve element 146*b* having a valve plug 152*b* and a valve stem 154*b*. Further, there is a compression spring 148*b* urging the valve stem 146*b* to the left so as to remain in the open position. Further, there is the valve chamber 178*b*, and the passageways 180*b* and 182*b*.

However, in this second modified version, instead of making the valve element 146*a* as a single piece, it is formed in two pieces. First, there is the valve stem 154*b* which comprises a forward larger diameter portion 186 and a reduced diameter portion 187. The valve plug 152*b* is made separate from the stem 154*b* and has a sleeve 188 which is slide mounted around the forward stem portion 186 and is fixedly connected to the plug element 152*b* through a frusto conical portion having several openings 190. The sleeve 186 has its rear edge bearing against a moderately enlarged stem portion 192 that forms a shoulder.

The upstream facing portion of the plug 152*b* has a center opening 194 that exposes a forward middle surface portion 196 of the stem 154*b* to the upstream pressure in the passageway portion 48.

The operation of this second modified embodiments 8A through 8C will now be described. In the position of FIG. 8A, the selector valve 60*b* is in its normal bypass mode, where the volumetric flow rate through the passageway 48 is sufficiently low so that the combined fluid flow and pressure force exerted against the valve plug 152*b* is not great enough to overcome the force of the spring 148*b* and move the valve element 146*b* back to its operating position. In this instance, the valve is operating in substantially the same way as the valve 60*a* as shown in FIG. 7A.

With reference to FIG. 8B, when it is desired to move the control valve 60*b* to the operating mode, as in the prior embodiments, the volumetric flow rate of the drilling mud is raised, the effect of this being that a greater force is exerted on the valve plug 152*b*. This moves the entire valve element 146*b* rearwardly to the position of FIG. 8B. In the operating mode of FIG. 8B, since the positioning spring 148*b* pushes against the valve stem 154*b* which also pushes against the valve plug 152*b*, the surface 184b and the surface 196 of the forward part of the valve element 154*b* function in substantially the same manner as the surface 184 of the first modified embodiment of FIGS. 7A and 7B.

As indicated above, in the operating mode of FIG. 8B, all of the flow from the upstream annular passageway 48 is directed through the passageway 182*b* into the intensifier section 18 to cause ultra high pressure drill mud to flow through the jet nozzles 68 in the liquid jet cutting mode.

However, let us assume for some reason there is a blockage or malfunction in the intensifier section 18. In order to provide for pressure relief, the strength of the positioning spring 148b is selected, relative to the affected areas and size of the other components, so that when an abnormally high pressure is reached, the force of that pressure acting only on the forward valve element surface portion 196 is sufficiently great to overcome the force of the positioning spring 148b. This causes the valve stem portion 186 and the rear stem portion 170b to move rearwardly to the position of FIG. 8C. However, since the valve plug 152b is already seated in its closed position, the valve plug 152b cannot move any further to the right. This opens the central opening 194 which in turn communicates with the openings 190 to cause the bypass flow through the passageway 180b.

When pressure of the drill mud in the passageway 48b is lowered, the valve element 146b will return to the position of either FIG. 8B or FIG. 8A.

iii. Third Modified Embodiment of the Selector Valve (FIG. 9)

This third alternative embodiment of the control valve is shown in FIG. 9. Components of this third modified embodiment which are similar to the components of the prior embodiments of the selector valve will be given like numerical designations, with a "c" suffix distinguishing those of the present embodiment.

In FIG. 9 the upstream direction is at the right of the selector valve 60c. Accordingly, the flow of the drill mud from the drill stem comes into the passageway 48 which is on the right, and the downstream passageway is to the left at 56.

As in the prior embodiments, there is a valve element 146c having a valve plug 152c which is urged to its bypass position by a compression spring 148c. The valve plug 148c faces toward a flow passage 198 which receives a flow from the passageway 48. As shown in FIG. 9, the valve plug 152c is positioned away from its valve seat 158c due to the urging of the spring 148c. When the volumetric flow through the annular passageway 48 is at a lower level, the valve element 146c remains in its bypass position to permit the flow of the fluid around the valve plug 152c. As in the prior embodiments, when the pressure is raised to the operating level to cause the intensifier section 18 to operate, this volumetric flow is sufficiently high to push the valve element 152c back into its seated position against the seat 158c and cause drill mud from the passageway 48 to flow entirely through the intensifier section 18.

To provide for pressure relief at a very high pressure which might be encountered during a blockage, a second valve element 200 is provided, and the head 202 of this valve element is exposed only through a relatively small opening 204 in a stop member 206 positioned in front of the head 202. There is a spring 208 which urges the valve element 200 toward its closed position. When an abnormally high pressure is reached in the upstream passageway 48 (presumably due to a blockage in the intensifier section 18) the pressure acts upon the exposed surface 204 to push the valve element 200 rearwardly and permit the flow of the drill mud by the valve element 200 and through the bypass passageway 210 to flow out the downstream annular passageway 56.

b. Further Description of the Trigger Valve 64

Figure 10:
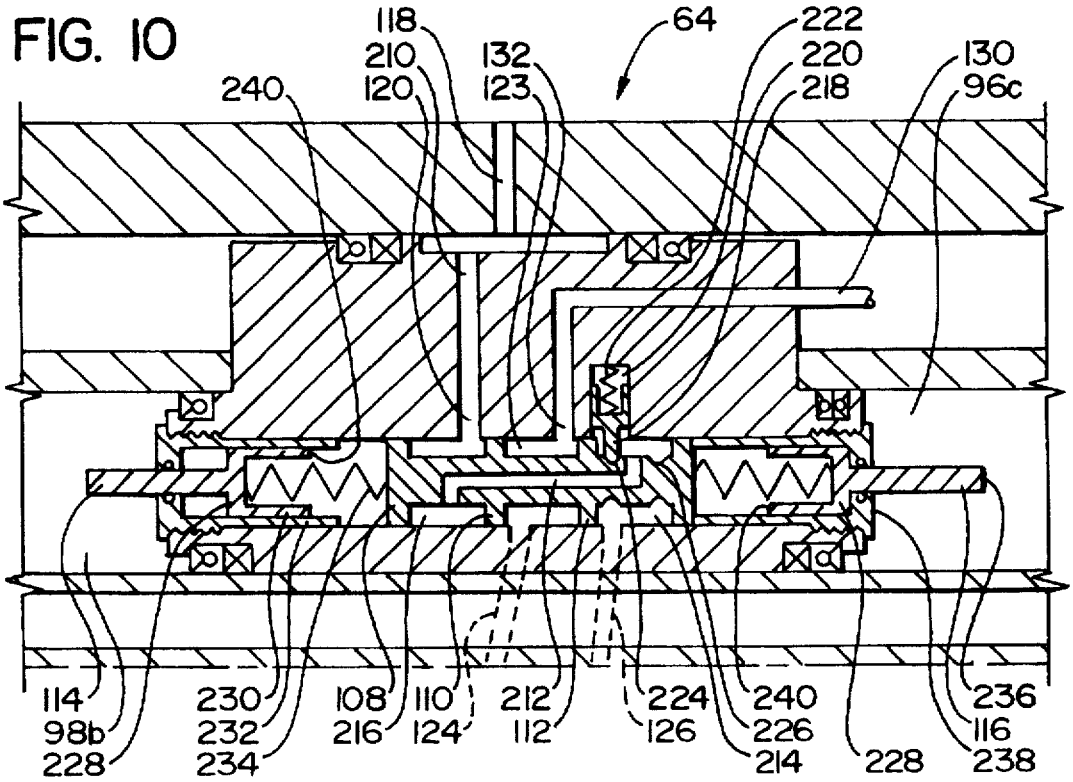
FIG. 10 is a semi-schematic longitudinal view showing the trigger valve somewhat schematically.

Reference is made to FIG. 10, which shows the trigger valve 64 in more detail. As indicated in an earlier section of this text, the trigger valve 64 in FIGS. 2 through 5 was shown somewhat schematically, and it was indicated earlier that this would be shown in more detail later in this text. In the following description, there will first be discussed the elements shown in FIG. 10 which are also shown in FIGS. 2 through 5 (some of which are shown in FIG. 10 in a somewhat modified form). Then this will be followed by a more detailed description of the additional elements shown in FIG. 10, but which were not shown in FIG. 2 through 5.

As shown in FIG. 2 through 5, the trigger valve 64 comprises a valve element 108 having the two spools 110 and 112. Also, there are the two trigger fingers 114 and 116. However, it will be noted that these fingers 114 and 116 are not attached directly to the valve element 108, and this will be discussed later herein.

There is the inlet passageway 130 which delivers the twice filtered drill mud through the port 132 into the central trigger valve chamber 123. This valve chamber 123 in turn leads to either of two passageways 124 and 126 to the control valve 62. More particularly, with the valve element 108 in the right hand position, as shown in FIG. 10, the pressurized drill mud flows from the passageway 132 through the chamber 123 and through line 124 to the control valve 62 while line 126 is connected to exhaust passage 118 via passage 210, chamber 216, passage 212 and chamber 214. With the valve element 108 moved to the left, the passageway 132 communicates through chamber 214 with the passageway 126, and the passageway 124 is connected to exhaust passages 210 and 118. In this manner, the flow of the drill mud is delivered alternately to the two sides of the central chamber 128 of the control valve 62.

In the schematic showing in FIG. 2 through 5, there was shown the low pressure outlet line 118 which connected to two ports at opposite ends of the valve chamber. However, in the embodiment shown in FIG. 10, there is only one line 210 which leads from the port 120 at the left end of the valve chamber. There is built into the valve spool a cross over passageway 212 which leads from the right hand chamber 214 through the center line of the valve element 108 to connect to the left hand chamber portion 216. Thus, the chamber portion 214 discharges through the passageway 212 through the chamber 211, line 210 and line 118.

As disclosed previously herein, in the description connected with FIGS. 2 through 5, the valve element 108 is moved between its right and left hand positions by the adjacent pistons (either 32b or 32c) engaging alternately the trigger fingers 114 and 116. This causes the shifting of the valve element 108 from first one side and then to the other so that fluid is directed alternately through the passageways 124 and 126, thus shifting the control valve element 84 from one side to the other to reverse flow into the lowest pressure chamber sections 96a, *b* and *c* and 98a, *b* and *c* of the intensifier section 18.

The components which will now be described in the trigger valve 64 relate to the previously mentioned "snap action" which provides for the very rapid shifting of the valve element 108 of the trigger valve 64. In FIG. 10, there is shown a retaining finger 218 positioned in a recess 220. Also, positioned in the recess 220 is a compression spring 222 which urges the finger 218 into engagement either with a first detente 224 formed in the valve element 108 or a similar detente 226 also formed in the valve element 108 and positioned a short distance to the right of the other detente 224.

The spring 222 exerts sufficient force on the finger 218 so that when it is positioned in the detente 224 or 226, there is required a predetermined lateral force exerted on the valve element 108 to be able to move the valve element 108 to raise the finger 218 and thus permit the valve element 108 to move. When the valve element 108 is moved from the right hand position of FIG. 10 to the left, then the retaining finger 218 moves into the other detente 226 to hold the valve element 108 in the left hand position.

Each of the trigger fingers 114 and 116 connects to a piston-like member 228 which has a mounting sleeve 230 slide mounted in a retaining sleeve 232. Each mounting sleeve 230 has an inward facing edge 240. For each trigger finger 114 and 116 there is a compression spring 234 positioned between a related end of the valve element 108 and the head portion of the piston 228 that connects to the trigger finger 114 or 116.

Each of the compression springs 234 is selected so that when it is compressed to a certain predetermined lengthwise dimension, it is able to exert a force which is sufficient to overcome the holding force of the retaining finger 218 and cause the valve element 108 to move.

To describe the operation of the trigger valve 64, let us first examine the position of the valve element 108 as shown in FIG. 10. Let us assume the piston **32*b* which would be just to the left of finger 114 had completed its travel in a right hand direction so as to have pushed the trigger finger 114 inwardly (i.e. to the right) so as to have caused the valve element 108 of the trigger valve 64 to have moved to the right hand position (as shown in FIG. 10). Then the piston assembly 28 begins moving to the left, and soon the piston 32 to the right of the finger 116 engages the finger 116 and begins to push it inwardly against the urging of its related spring 234. The valve element 108, the retaining finger 218 with its spring 222, and the spring 234 are designed so that when the outer end tip 236 of the finger 116 is moved in so that when it is just a short distance from the surface 238 of the adjacent portion of the valve housing, inward facing edge 240 contacts the valve element 108 and dislodges the retaining finger 218 from the detente notch 224. The valve element 108 then moves free of the finger 218. The stored up energy in the compressed spring 234 then moves the valve element 108 rapidly to the left hand position where the finger 218 comes into engagement with the other detente 226**.

The valve element 108 remains securely in this position until the piston **32*b* to the left comes into engagement with the left trigger finger 114 and moves it inwardly until its inward facing edge 240 contacts valve element 108 and dislodges it. Then the snap action takes place and the left hand spring 234 rapidly moves the valve element 108** to the right hand position.

This arrangement of the trigger valve 64 has two advantages. First, it provides for a very rapidly shifting of the valve element 108. As will be disclosed later herein with regard to the control valve 62, this rapid valve action is very advantageous in preventing wear in the control valve 62. The second advantage is that this arrangement forces the valve element 108 to be in one of two positions and makes its very unlikely that the valve element 108 will accidently become lodged at some intermediate position. The reason for this is that the springs 222 are selected so as to act on the valve element 108 with a relatively high force thus locking the valve element 108 securely in one of two positions. The spring 234 which is compressed will have a substantially higher force than the other spring 234 which is in a more relaxed position at the time inward facing edge 240 contacts the valve element 108. Thus the valve element 108 will move all the way from one position to the other. Springs 234 are selected so that in the compressed position, when inward edge 240 contacts valve element 108 the spring force exceeds opposing friction and fluid pressure forces acting on valve element 108.

c. The Control Valve

Figure 11:
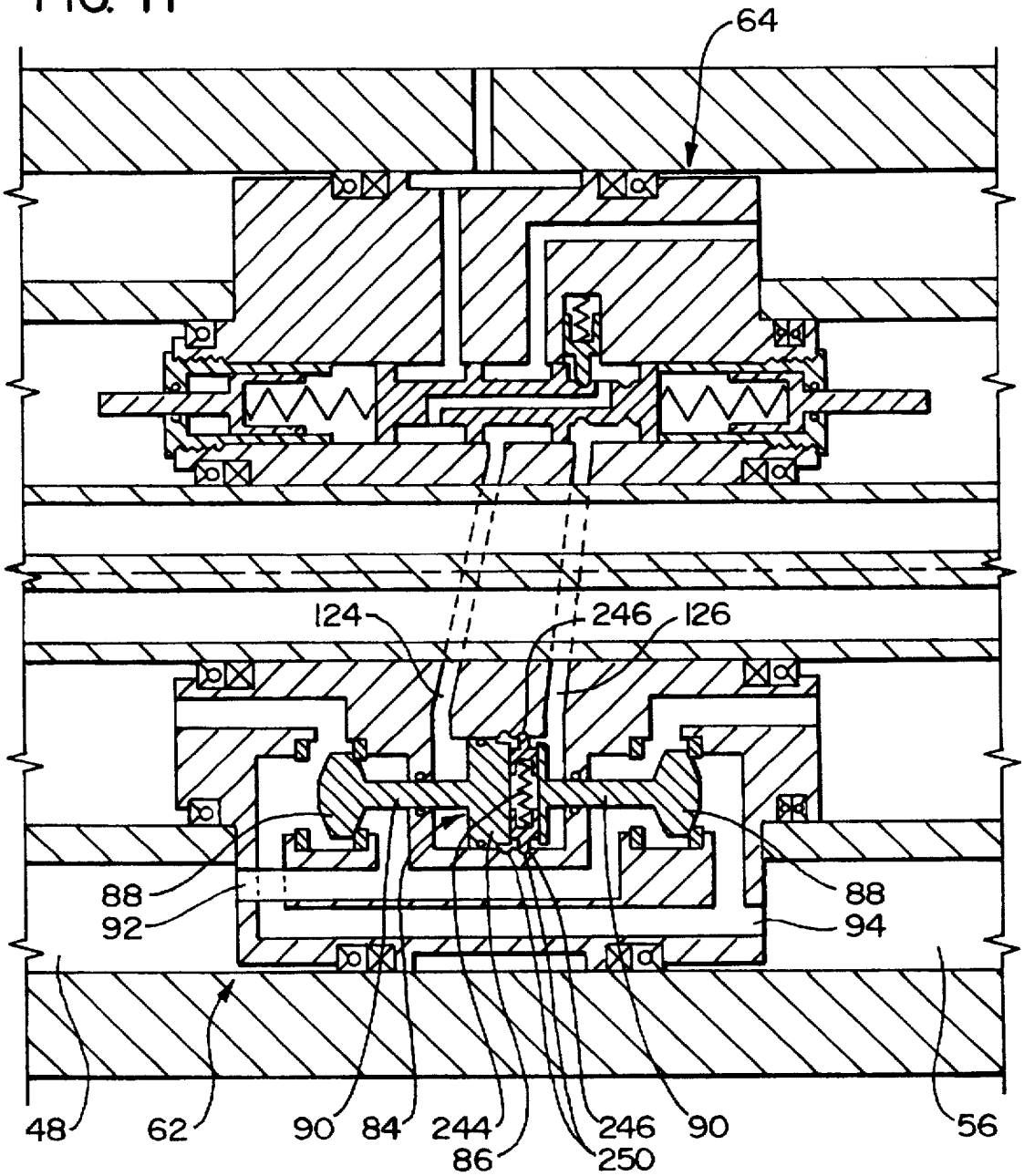
FIG. 11 is another semi-schematic view of only the trigger valve and the control valve.

Reference is first made to FIG. 11, which shows the control valve 62 and also the trigger valve 64 in the configuration substantially as shown in FIG. 10. The control valve 62 is shown somewhat schematically and is shown with basically the same configuration as shown in FIG. 2 through 5, except that in FIG. 11, there is shown a poppet type control valve instead of a clearance seal type spool valve and there is shown a snap action feature similar to that used in the trigger valve of FIG. 10.

In FIG. 11, the central piston 86 has formed therein a transversely extending recess in which is positioned a compression spring 244, the opposite ends of which press ball elements 246 (or other retaining elements) into matching recesses or detentes which are formed in the adjacent valve housing surface defining the central chamber. There are right and left sets of detentes 250 so that the valve element 84 is held in place in either its full right hand position or its full left hand position.

In operation, the control valve 62 functions in substantially the same manner as described earlier herein in the description given relative to FIGS. 2 through 5. The advantage of the spring retaining device 244-246 is that the valve element 84 remains securely held in one or the other of its end positions until a sufficiently high pressure is exerted on the face of the piston 86 being subjected to higher pressure to overcome the restraining force of the retaining member 246-248. When that level of pressure has been exerted, it is sufficiently high so that it will very rapidly move the valve element 84 to its opposite position. Further, this arrangement causes the action of the control valve 62 to be relatively rapid since the valve element 86 does not even begin its movement until a sufficiently high force is exerted on it to cause it to accelerate very rapidly to its opposite position.

Figure 12A:
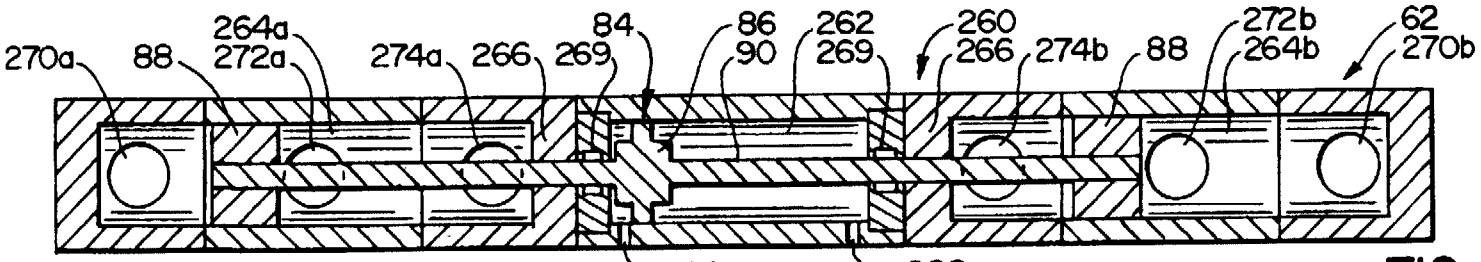
FIG. 12A is a longitudinal sectional view showing somewhat schematically the valve element and the housing structure of the control valve.
Figure 12B:
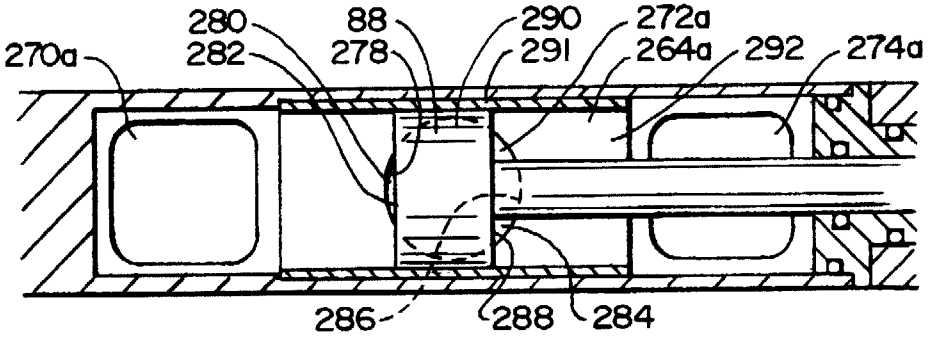
FIG. 12B is a longitudinal sectional view showing a portion of the control valve where one of the valve spools is passing by the center port of one side of the valve.
Figure 12C:
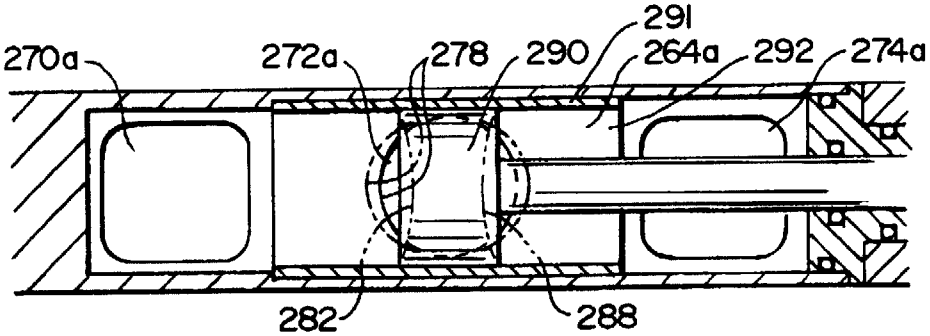
FIG. 12C is a view similar to FIG. 12B, showing the valve portion of FIG. 13B, but with the central port and spool being worn away to some extent.

To describe further the control valve 62 of the present invention, reference is made to FIGS. 12A, 12B and 12C. Reference is first made to FIG. 12A which illustrates only the valve element 84 having the piston 86, end spools 88, connecting rods 90, and also the valve housing. As indicated previously, the illustrations of the control valve 62 in FIGS. 1, 2 through 5 and also in FIG. 11 are somewhat schematic. FIGS. 12A, 12B and 12C illustrate a preferred configuration of a valve element 86, the housing defining the valve chambers, and also the ports, with the housing 267 being shown somewhat schematically.

To appreciate the significance of the valve configuration shown in FIGS. 12A, 12B and 12C, it needs to be recalled that the main flow of drill mud which passes through this control valve 62 is made up of the once filtered drill mud which is used to drive the larger pistons 32. Also, as indicated previously, this drill mud is made up of a carrying liquid which has small solid particles suspended therein which can be rather abrasive. The pressure of the drill mud passing through the control valve 62 can be as high as, for example, 3,000 PSI or higher. Accordingly, it is highly desirable that the control valve 62 could be configured in such a manner to alleviate as much as possible the adverse effects of the abrasion which would undoubtedly be caused, at least to some extent, by this drill mud.

For ease of description, no attempt will be made to correlate the numerical designations of the ports and other portions of the valve components shown in FIGS. 12A, 12B and 12C. Rather, totally new numerical designations will be given.

The valve housing 260 is shown in a somewhat simplified form. This housing 260 is configured to define a central cylindrical chamber 262 in which the piston 86 reciprocates, and two cylindrical end chambers **264*a* and 264*b*, in which the related spools 88 reciprocate. The central chamber 262 is separated from the adjacent chambers 264*a* and 264*b* on opposite sides by suitable partition walls 266. There are shown two inlet/outlet ports 268 leading to the central chamber 262 to move the piston 86 back and forth in the chamber 262. Seals are shown schematically at 269**.

There are three sets of ports, namely two outer ports 270*a* and 270*b*, two central ports 272*a* and 272*b*, and two inward ports 274*a* and 274*b*. At each port location, the number of passages through housing 260 could be one, two or more.

The left middle port 272*a* connects to the higher pressure upstream annular passageway 48, while the right middle port 272*b* connects to the lower pressure downstream annular passageway 56. The ports 274*a* and 274*b* connect to the chamber portion 98*b*, while the ports 270*a* and 270*b* connect to the chamber portion 96*c*.

The ports 270*a* and *b*, 272*a* and *b* and 274*a* and *b* have been shown on only one side of the housing 260. However, it is to be understood that in the preferred configuration, each port 270*a* and *b*, 272*a* and *b* and 274*a* and *b* has a matching diametrically opposed port so that the flow through each set of diametrically opposed ports is from both sides of the housing 260.

It can be seen that in the position as shown in FIG. 12A, there is an inflow of pressurized fluid from the upstream passageway 48 through the left port 272*a* into the left hand chamber 264*a* and into the port 274*a*. The port 270*a* is blocked off from any other port, and hence there is no flow through the port 270*a*.

In the right hand chamber 264*b*, the port 274*b* is blocked off from any other port, and hence there is no flow through it. On the other hand, there is flow through the middle port 272*b*, into the right hand chamber 264*b*, and outwardly through the port 270*b* to finally flow to the downstream passageway 56.

Since these ports 270*a* and *b*, 272*a* and *b* and 274*a* and *b* are made relatively large, the flow of the fluid through these ports when the ports are fully open is not at a very high velocity.

To review the operation of the control valve 62, let us assume that the piston assembly 28 is traveling from one side to the other and is about half way through its path of travel, and that the control valve 62 is positioned as shown in FIG. 12A. There is a substantially constant flow of higher pressure drill mud from the upstream annular passageway 48 through the port 272*a* into the left hand chamber 264*a* and thence out the port 274*a* to the chamber portion 98*b* from which the flow continues on into the chambers 98*a* and 98*c*, causing the piston assembly 28 to move to the left, as seen in FIGS. 2–5. At the same time, there is a flow from the other set of chamber sections 96*c*, 96*a* and 96*b* through the port 270*b* into the right chamber 264*b* and outwardly through the port 272*b* to flow into the downstream annular passageway 56.

Let us now assume that the piston assembly 28 has nearly reached its end limit of travel and has shifted the trigger valve 64 to its other position. This immediately causes an inflow of the twice filtered drill mud into the left port 268 to very rapidly act on the center piston 86 to move the valve element 84 to the right. This reverses the direction of travel of the piston assembly 28.

Let us direct our attention to FIG. 12B which shows the left hand ports 270*a*, 272*a* and 274*a*, where there is shown the related spool 88 having moved away from its left hand position shown in FIGS. 12A nearly to its midway location relative to the left middle port 272*a*. Just prior to this time, the left hand high pressure port 270*a* has been totally isolated from its related middle port 272*a*. At the same time, there had been a flow of once filtered drill mud from the upstream passageway 48 through the port 272*a* into the left chamber 264*a* and out the port 274*a* to flow to the chamber port 98*b*.

However, as soon as the left hand spool 88 moves past the extreme left edge 278 of the middle port 272*a*, this opens a small gap 280 formed by the edge 278 of the left of the edge of the port 272*a* and the adjacent edge 282 of the cylindrical spool 88. There is an immediate rapid flow of the higher pressure once filtered drill mud through the small gap 280. As the spool 88 moves very rapidly a short distance farther, the area of the gap 280 increases very rapidly, which causes a corresponding decrease in the velocity of the flow through the gap 280.

As the very small gap 280 is formed, it can be seen that the left hand spool 88 in moving to the right has already been forming what was initially a rather large gap 284 that is shaped as a segment of a circle, and is formed by the right hand edge 286 of the left hand port 272*a* and the right adjacent edge 288 of the left hand spool 88. Thus, as the left hand spool 88 continues its rapid movement to the right, this gap 284, as its area decreases to a small amount, will experience a brief period of somewhat higher velocity of flow of once filtered drill mud through this gap 284 into the right hand portion of the chamber 264*a* and out the port 274*a*, after which this flow through the port 274*a* is shut off, until the valve element 86 shifts back again.

This same condition exists with respect to the right hand spool 88 and central port 272*b*. However, the flow is outwardly from the chamber 264*b* through the port 272*b*. Because the ports 272*a* and 272*b* are never completely closed off by spools 88 the pressure fluctuations in the fluid in intensifier section 18 are substantially reduced. This reduces possible damage to the ports of intensifier section 10 that would occur if pressure fluctuation are too severe.

The outer cylindrical surface 290 of each of the spools 88 is coated with or formed from a very hard material that has high resistance to abrasion from the small particulate matter in the drill mud. A typical material would be, for example, tungsten carbide. Also, in the area where each of the spools 88 reciprocates, the interior surface of the housing 260 that defines the central part of the chambers 264*a* and *b* in which each spool 88 reciprocates is made of a sleeve 291 of a high wear resistant material.

However, even with the use of high wear resistant material, a certain amount of wear is expected in both the edges 280 and 286 of each middle port 272*a*, and also at the adjacent edge portions 282 and 288 of the spool. However, even though these edge portions wear, the main circumferential side surface 290 of each spool 88, and also the main cylindrical surface portions 292 of the interior of the sleeve lining 291 do not experience this severe sear. Therefor, when each of the spools 88 is in either of its end positions of travel, the surfaces 290 of these spools 88 and the surface portions 292 of each of the liners 291 form a relatively close tolerance fit between one another so that there is very little (or substantially no) leakage Also, with the drill mud having small particulate matter therein, any leakage flow soon becomes clogged because the small particles in the mud tend to block any leakage flow.

The pattern of wear is shown in FIG. 12C, and the edges 282 and 288 of the spool 88 that are being worn away are indicated by broken lines in FIG. 12B, as are the edges 278 and 286 of the related middle opening port. The wear does not occur on the sealing surfaces.

Also, with the trigger valve 64 and also the control valve 62 having very rapid action, the time periods where there is any transition flow as the valve element 84 is moving from side to the other are extremely short, this also alleviating the problem of wear.

d. The Filter System

Figure 13A:
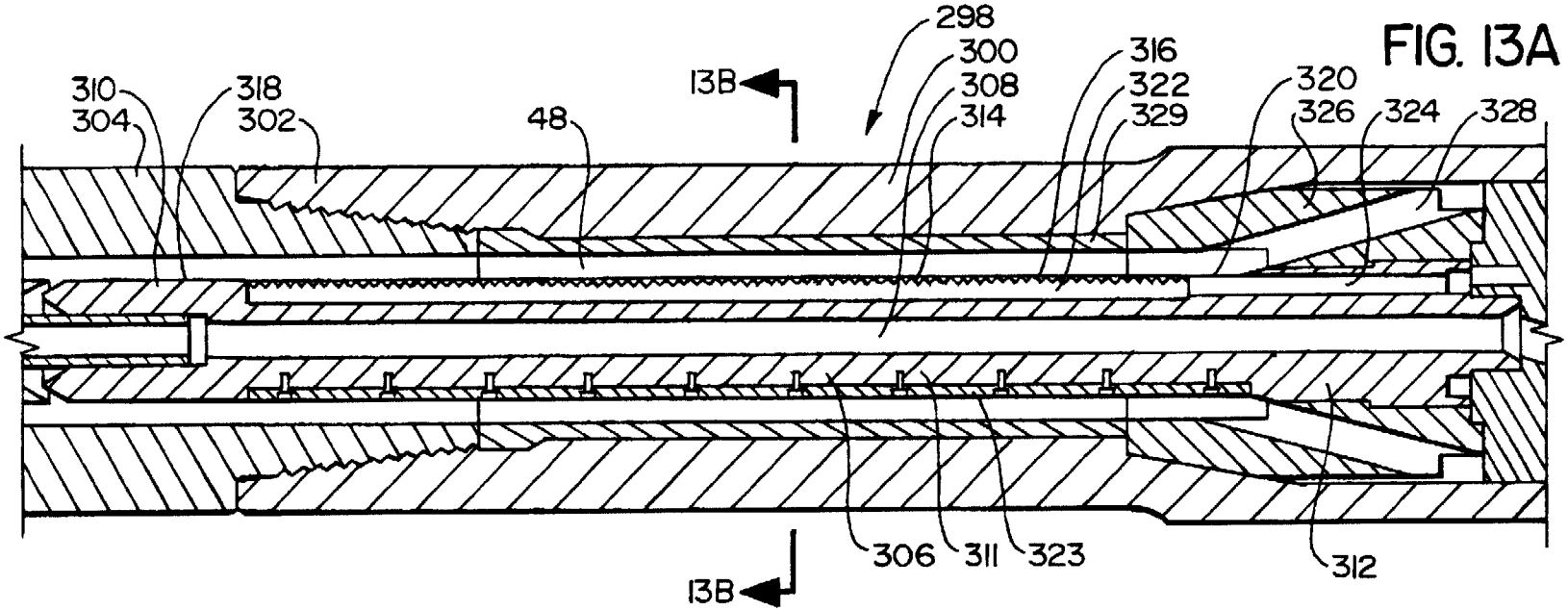
FIG. 13A is a longitudinal sectional view of one version of a fine mesh filter at the upstream end of the assembly.
Figure 13B:
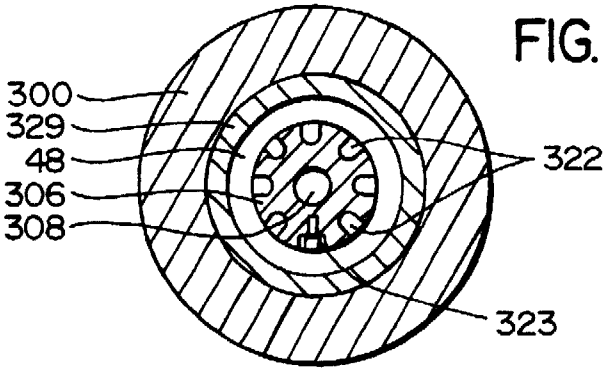
FIG. 13B is a sectional view taken at line 13B—13B of FIG. 13A.

Reference is now made to FIGS. 13A and 13B which illustrate an upstream portion of the assembly 10 where the fine mesh filter section 298 of the filter system is located. The fine filter section 298 of the assembly 10 shown in FIG. 13 is a short distance upstream of the upstream ultra high pressure chamber 38 in which the upstream plunger 34 reciprocates. As will be seen when we reach that portion of the text relating to FIG. 15A–15C, there is also a relatively coarse filter which is positioned further upstream from the fine mesh filter section shown in FIG. 13. That course filter will be described later in this text.

In FIG. 13A, there is shown a section 300 of the outer tubular housing 16, and at the upstream side of this housing section 300 there is a connecting portion 302 which threadedly engages yet further upstream housing portion 304 of the outer tubular housing 16. Within these sections 300 and 304 there is a portion of the aforementioned upstream annular passageway 48.

Positioned concentrically within the housing section 300, there is a generally cylindrical filter housing 306 having a central elongate chamber section 308, which in this particular configuration is an upstream end portion of the aforementioned attenuator 76. This housing 306 has a generally cylindrical configuration and has a moderately enlarged upstream end at 310 having a slightly larger diameter than the central portion 311, and having a similar section 312 at the downstream end, also of a moderately larger diameter. Thus, there is formed a relatively thin circumferential recess which can be termed a filter recess, and in this recess there is positioned a cylindrical filter screen 314. The outer surface 316 of this filter screen lies in the same cylindrical plane 318 that is occupied by the upstream and downstream housing portions 310 and 312. Thus, it can be appreciated that the annular upstream passageway 48 has substantially uninterrupted flow as it proceeds from the cylindrical surface 318, parallel to the circumferentially outer screen surface 316 and on to the downstream outer surface 320.

As can be seen in FIG. 13B, the central housing section 311 is formed with a plurality of longitudinally extending grooves 322 that extend the entire length of the central housing section 306. As shown herein, there are seven such grooves spaced circumferentially at substantially equal intervals around the housing section 306. To hold the screen 314 in place, there is provided a retaining bar 323, which in tun fastens to the central housing section 311 to screws or other means.

At the downstream end of the section 306, there is formed in the downstream end sections 312, a plurality of longitudinally extending passageways, one of which is indicated as 324 through which the drill mud can flow from the grooves 322 further downstream. These grooves 322 in turn lead to the several flow passages disclosed previously herein through which the twice filtered drill mud is directed toward the trigger valve 64, the control valve 62, and also the inlet check valves 78 for the two ultra high pressure chambers 38.

Also, there is at the downstream end of the housing section 308 a circumferential fitting 326 which has diverging passageways 328 that lead from the annular passageway 48 to a further downstream portion of the annular passageway 48. A sleeve 329 is positioned within the housing section 300 and between the fitting 326 and the upstream housing portion 304.

To describe the operation of the fine filter screen assembly 298 shown in FIGS. 13A and 13B, as indicated previously herein (and as will be described more fully later herein), there is a first coarser yet further upstream filter which screens out the more coarse material in the drill mud. Then the once screened drill mud passes down through the portion of the annular passageway 48 that surrounds the cylindrical screen member 314. During the by-pass operating mode of the assembly 10 there is reduced flow or no flow of the twice filtered drill mud to the trigger valve 64 and flow control valve 62. Also, the piston assembly 28 may be reciprocating slowly or be dormant. Thus, there may be little or no flow from the annular passageway 48 through the fine mesh screen 314.

However, let us assume that the piston assembly 28 is to be placed in full operation. As described previously, this is done by increasing the volumetric flow of the drill mud through the outer annular passageway 48 so that this moves the selector valve 60 to its by-pass mode where the once filtered drill mud is diverted into the pressure intensifier section 18.

When this happens, there will be a flow of once filtered drill mud through the control valve 62 and into one set or the other of the chamber sections 96*a, b* and *c* and/or 98*a, b* and *c* to cause the piston assembly 28 to reciprocate, depending on the position of the control valve 62. Immediately, one of the plungers 34 will be on its intake stroke, thus causing a pressure reduction at its intake valve 78 and initiating a flow of twice filtered drill mud from the screen slots 322 and the passageways further down stream in which the twice filtered drill mud is positioned. This in turn causes the flow of a smaller portion of the once filtered drill mud to pass through the screen 316, into the slots 322 and through the various passageways as described previously herein.

A potential problem of screening the drill mud with a fine mesh screen is the clogging of the openings in the screen. It has been found that this is uniquely solved and the arrangement shown in FIG. 13A and 13B in that the main flow of the drill mud is through the annular passageway 48 surrounding the outer surface of the screen 31.6. It has been found that the particles of the drill mud which tend to collect in the openings of the fine mesh screen 314 are scoured away by the flow of the drill mud passing parallel to the outer circumferential surface 316 of the screen 314.

The fine filter screen 316 is in this preferred embodiment made from fine mesh wire screen of 60–320 mesh size supported by closely spaced grooves or a coarse mesh screen on housing element 306.

e. The Piston Assembly 28

By way of introducing this concept for the design and configuration of the piston assembly such as shown at 28, reference is first made to 14A which is a simplified rather schematic drawing of a piston assembly 28. There is shown schematically a longitudinal sectional view of an ultra high pressure intensifier 340, comprising a housing 342 and a piston assembly 344. As shown herein, the piston assembly 344 comprises three larger diameter pistons 346 interconnected and spaced from one another, and two end plungers 348. The two end plungers reciprocate in related ultra high pressure chambers 350.

Each piston 346 has its related chamber 352, with the chambers 352 defined by two housing end portions 354 and two intermediate partitions 356. As described previously each of the pistons 346 is caused to reciprocate in its perspective chamber 352, by directing high pressure fluid first on one side of the several pistons 346 and then on the other side.

To interconnect the pistons 346 and the plungers 348, there is provided a single tie rod 358 which extends the entire length of the piston assembly 344. Thus, one end 360 of the tie rod extends from the extreme right hand end 360 of the ultra high pressure plunger 348 to the far left end 362 of the left hand ultra high pressure plunger 348.

Each plunger 348 comprises a cylindrical block 364, and the tie rod extends through both of these blocks 364. At each of the ends 360 and 362 of the plungers 348, there is provided a threaded nut 366 which is threaded onto the related end of the tie rod 358 and which bears against a related washer 368 that presses against its related plunger block 364 to place the two blocks 364 in compression. At the same time, the central tie rod 358 is placed in tension.

The three large diameter low pressure pistons 346 are mounted concentrically on the tie rod 358, and there are two spacing sleeves 370 positioned around the tie rod 358 on opposite sides of the middle piston 346 and bearing against the two pistons 346 on opposite sides of the central piston 346. Due to the tension force imparted by the tie rod 258, these sleeves 370 are also placed in compression. The end nuts 366 are pre-torqued so that it will keep the components of the piston assembly 344 (other than the tie rod 358) in compression, thus preventing any relative motion between the components. To maintain the retaining nuts 366 in place, these can be castellated nuts applied with a cotter pin to insure that these nuts 366 do not back off. Seals are installed at each component joint where required.

With regard to the manner in which this piston assembly 344 functions, it should first be realized that down hole tools experience high levels of vibration and accelerations. If fasteners such as nuts, bolts, snap rings, etc. are used, these have a tendency to come loose during operation. In the piston assembly 344 described herein, there is minimum of fasteners.

Also, by pretorquing the tie rod 358 to a sufficiently high level, each of the plungers 348 are maintained in compression, thus reducing tensile fatigue loads due to lateral accelerations. This can be accomplished by pretorquing the tie rod 358 to a sufficiently high force level so that even when one of the plunger blocks 364 is subjected to very high compression loads on its power stroke, thus relieving the compression loads on the other block 364, both blocks 364 still remain in compression.

Another feature of this concept is that the spacing sleeves 370 and also the rods 358, if needed, can be made of a sufficiently large interior diameter so that there is an annular passageway between the outer surface of the tie rod 358 and the sleeves 370 and 364. Also, the tie rod 358 can be made with an interior passageway 372. The passageway 372 and the annular passageway can function as the two supply passageways which direct the pressurized fluid into the chambers 352 and also permit the outflow of the low pressure fluid being discharged from the chamber 352 as will be described later herein.

Figure 14A:
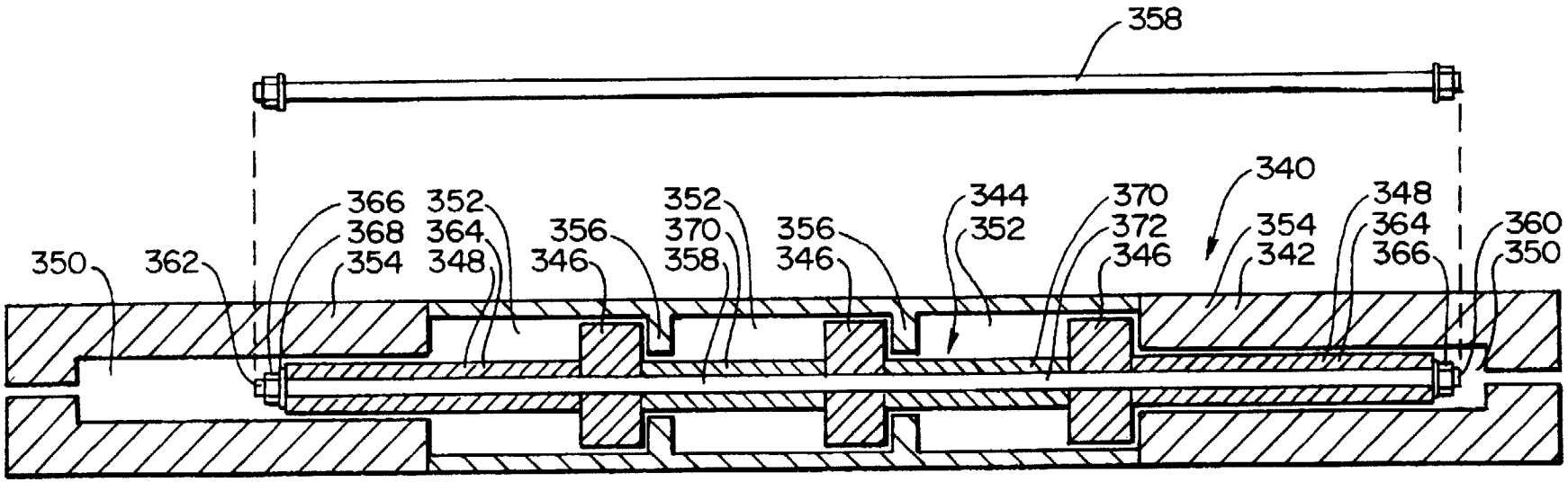
FIG. 14A is a somewhat schematic longitudinal sectional view of one version of the piston assembly of the present invention.
Figure 14B:
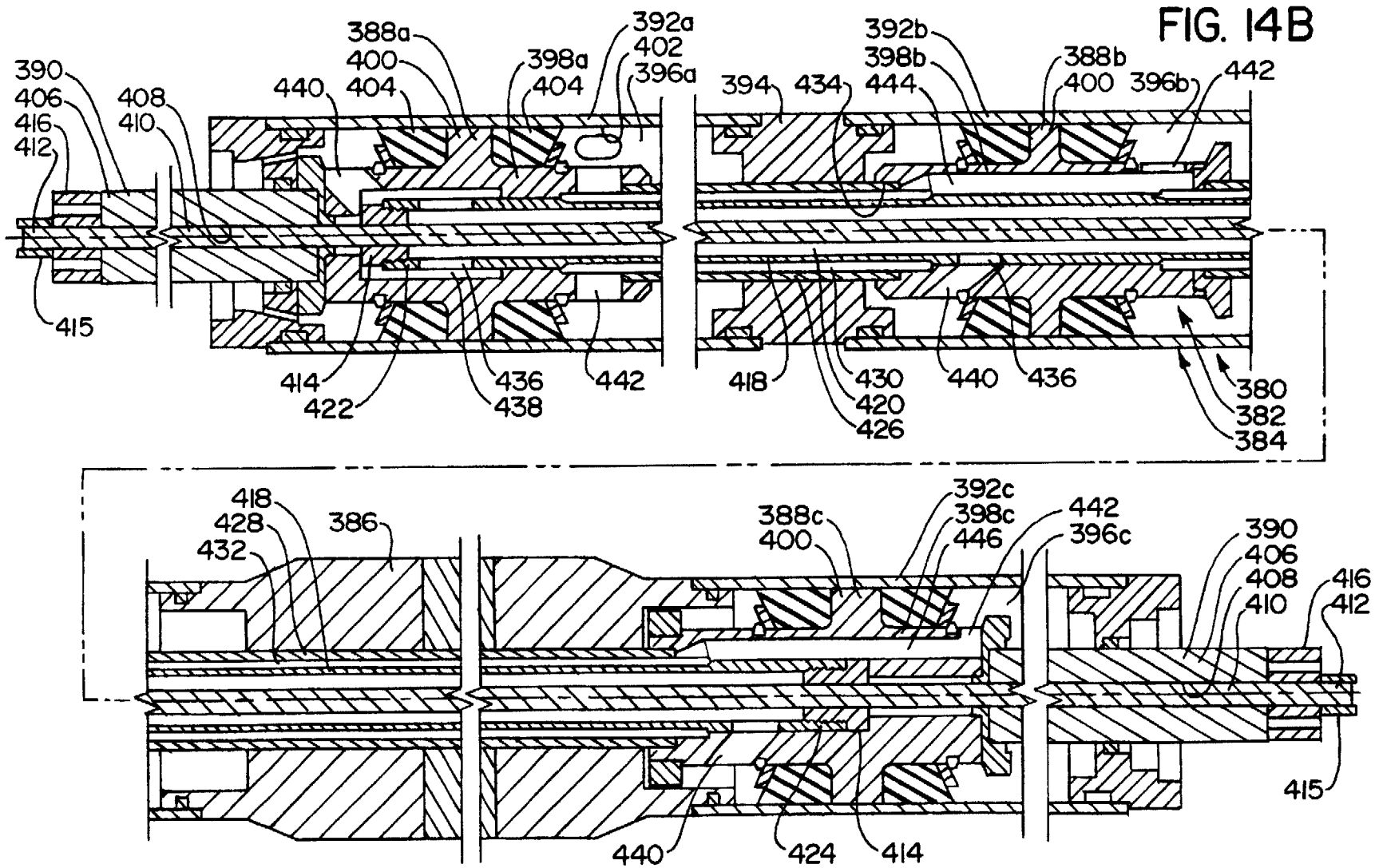
FIG. 14B is a view similar to FIG. 14A which shows a modified version of the piston assembly.

A modified embodiment of a piston assembly incorporating the general concept described with reference to FIG. 14A is shown in FIG. 14B. In FIG. 14B, there is shown part of a pressure intensifier system 380 comprising a piston assembly 382, a housing 384 for the piston assembly, and a valve housing 386. This pressure intensifier system 380 has its basic components and mode of operation substantially the same as shown in FIGS. 2–5, with certain structural features in the arrangement of the piston assembly 382 to incorporate the general concept discussed above with reference to FIG. 14A.

The piston assembly 382 comprises three larger low pressure pistons 388*a*, 388*b* and 388*c*, and two end plungers 390 connected to, respectively, the pistons 388*a* and 388*c*. The housing 384 comprises a generally cylindrical sidewall 392 made of three separate cylindrical housing sections 392*a*, *b* and *c*. The two sections 392*a* and 392*b* are both connected to a partition wall 394 which separates the housing chamber 396 into two chamber portions 396*a* and 396*b* in which reciprocate the two pistons 388*a* and 388*b*. The two housing side wall sections 392*b* and 392*c* both connect to the valve housing 386, with the valve housing separating the two chamber portions 396*b* and 396*c*, and with the third piston 398*c* reciprocating in the chamber section 396*c*.

It is to be understood that the housing 384 also comprises two end housing sections (not shown for ease of illustration) containing the two end ultra high pressure chambers in which the plungers 390 reciprocate. Each piston 388 comprises a central body portion 398 made integrally with a peripheral flange 400 which fits against the inside surface 402 of its related housing sidewall 392*a*, *b* or *c*. There are piston seals 404 positioned around the central piston portion 398 and on opposite sides of a related piston flange portion 400. Other seals are provided at the locations where required in the pressure intensifier 380.

To describe the manner in which the teachings discussed previously in connection with FIG. 14A are incorporated in this pressure intensifier system 380, we begin at the left plunger 390 which comprises the cylindrical plunger block 406 having a central longitudinal opening 408 to receive a central rod 410 having a threaded outer end 412 and an inner support member 414 having a somewhat larger diameter than the rod 410 and its opposite end 412. There is a retaining member or washer 416 threaded onto the outer rod end 412 and tightened down against the plunger block 406 by nut 415 to place the rod 410 in tension.

The inner support member 414 of the rod 408 has exterior threads which connect it to a cylindrical rod section 418 that defines a central passageway 420. The left end 422 of the tubular rod section 418 is threadedly connected to the support member 414. The tubular rod section 418 extends through the partition wall 394, through the middle piston 388*b*, through the valve housing 386, all the way to the right piston 388*c* where it has a right end 424 that is threadedly connected to a support member 414 in the same manner as the other plunger 390.

It will become apparent from the following description that the rod 410 serves the same function of the tension rod 358 of the embodiment shown in FIG. 14A. Further, the passageway 420 defined by the central rod section 418 functions as a passageway for the drill mud to direct the drill mud to and from the chamber portions to the left side of the pistons 388*a*, *b* and *c* in their respective chambers 396*a*, *b* and *c*.

With the rod member 410 providing the tension loads for the piston assembly 382, it is required to have structure to transmit the counterbalancing compression loads through the piston assembly 382. This is accomplished by providing two tubular outer rod sections, one tubular rod section 426 extending between the pistons 398*a* and 398*b*, and a second tubular rod section 428 extending between the two pistons 388*b* and 388*c*. These rod sections 426 and 428, in addition to taking the compression loads between the pistons 388*a*, *b* and *c* also define with the adjacent parts of the inner tubular rod section 418 two annular passageways 430 and 432 which carry the flow of drill mud to the portions of the chambers 396*a*, *b* and *c* to the right of the related pistons 388*a*, *b* and *c*, respectively. It will be noted that each of the outer rod sections 426 and 428 have their end sections fitting in related annular recesses formed in the related inner piston housing portion 398, one such recess being indicated at 434.

To direct the flow of fluid from the central passageway 420 into the three chambers 396*a*, *b* and *c*, there is provided at appropriate locations along the length of the inner rod section 418 outlet/inlet ports 436, each of which leads into an annular space 438 formed along the inside surface of a related piston housing portion 398. From the annular chamber 438, there is one or more outlet ports 440 extending into a related chamber 396*a, b* or *c*.

The openings which lead from the annular passageways 430 and 432 to the chambers 396*a, b* and *c* are formed in the piston housing portions 398 at the locations indicated at 442. The two annular passageway sections 430 and 432 are interconnected at the middle piston 388*b* by one or more passageways 444 formed in the piston portion 398. Also, the passageway 432 is connected to passageways 446 formed in the piston portion 398 of the right end piston 388*c*.

The valve housing 386 is simply illustrated schematically. It is to be understood that this valve housing 386 contains the valves described and shown in connection with FIGS. 2–5, namely the selector valve 60,the control valve 62, and the trigger valve 64. Accordingly, these will not be described in connection with this pressure intensifier apparatus shown in FIGS. 14B.

To describe further the construction and arrangement of this embodiment shown in FIG. 14B, as indicated previously, it can be seen that the rod 410 defines a central tie rod which is placed in tension loads by the two end nuts 415. The two end nuts 415 are thus pressed against the two washers 416 and the two plunger blocks 406. The left plunger block 406 bears against the piston housing 398 of the left piston 388*a*, and the right plunger block 406 bears against the piston housing 398 of the right piston 388*c*. The housing 398 of the left piston 388*a* in turn presses against the outer tubular rod member 426, which in turn presses against the housing 398 of the central piston 388*b*, which in turn presses against the outer tubular housing 428, which in turn presses against the housing 398 of the right hand piston 388*c*. Thus, the compression loads are reacted through the entire length of the piston assembly 382. As indicated previously in connection with the description of the embodiment of FIG. 14A, this arrangement of placing all of these components in compression alleviates the need for various connecting members, such as snap rings, etc. Further, with the central tie rod being preloaded, and with the entire plunger blocks 406 and the housings 398 of the pistons 388*a, b* and *c* being in compression, this reduces fatigue in these components due to lateral accelerations. Further, this prevents relative wear between the parts which can cause fretting and premature wear.

D. A More Detailed Description of a Preferred Embodiment of the Present Invention In FIGS. 15A, 15B and 15C, and also in the cross sectional views of 16–19, there is shown in more detail a preferred embodiment of the present invention, presenting more completely specific structure of many of these components. It is believed that the basic structure and functions of all of the components disclosed in FIGS. 15 A–C and 16 through 19 have already been disclosed adequately in the previous text so there is no need to repeat a great deal of that description and relate it to this embodiment. Accordingly, in the following description there will be more focus on the specific structure and components shown. Where certain components are the same as (or substantially the same as) components previously described in this text, then in most cases numerical designations corresponding to the numerical designations given to the prior described components will be given.

Also, since the main components and their relationships have been described previously in this text, there will not be an attempt in this particular section to give that overall orientation. Rather, the description will simply begin with FIG. 15A, proceeding from the inlet end toward the outlet end, and this same pattern will be followed through the description given with reference to FIGS. 15B and 15C.

One more item should be noted. In FIG. 1 the inlet end is shown at the right hand side of the drawing, and the outlet end where the drill bit is located is at the left hand side. In FIGS. 15A, B and C, the left to right orientation is reversed, so that the flow is from left to right in all of these Figures.

With reference to FIG. 15A there is shown at the upper left hand side of the drawing the lower end of the stem adapter 22 which in turn is connected in the lower end of the drill stem (not shown herein, but shown at 12 in FIG. 1). The stem adapter 22 is threadedly connected to the upper end of the outer tubular housing 16 which can be seen continued through FIGS. 15A, and 15B, and through part of 15C. In the upper part of FIG. 15A, there is shown a cylindrically shaped coarse filter 500 which receives the flow of the drill mud flowing through the central passageway 502 in the adapter 22. This filter 500 has an outside diameter moderately smaller than the inside diameter of the adjacent portion of the outer tubular housing 16 to provide an annular chamber 504 to receive the drill mud that flows radially outwardly through the coarse filter 500. This cylindrical filter 500 is mounted at its rear end in a recessed part of an insert 506 fitting within the outer housing 16, and the forward end is supported by a plug-like mounting member 508 having a nose portion 509 fitting into a recess in a forward mounting member 510. Surrounding the member 510 is a sleeve member 512 which has a plurality of downwardly and outwardly extending passageways 514 which receives the once filtered drill mud that flows through the screen 500 and into the chamber 504.

Mounted around the upper part of the member 510 is the upper end 516 of a cylindrical housing member 518 which comprises the sidewall of the aforementioned attenuator 74 defining the attenuator chamber 76. The lower end of the attenuator sidewall 518 is shown in the left hand portion of the lower part of FIG. 15A, and there is a stepped insert 520 positioned at the downstream end of the attenuator housing 518. At the forward end of this stepped member 520, there is mounted the fine filter housing 306 having the slots 322 formed therein, thus also defining ribs that support the fine filter screen 316. These components were described previously herein.

The flow that passes through the coarse filter moves through the passageways 514 and enters what is the upstream or upper portion of the upstream annular passageway 48 which is defined on the inside by the sidewall 518 and on the outside by the outer tubular housing 16. This flow of the once filtered drill mud proceeds downstream through the annular passageway 48 over the outside surface of the fine filter screen 316. In the pumping mode of operation, a portion of this flow passes through the fine mesh filter 316 and into the passageways 522 to flow to the inlet check valve 78. It is to be understood that these passageways 522 also have a connection to the aforementioned line 136 (not shown in FIGS. 15*a*, 15*b* and 15*c*) that extends through the annular passageways 48 and 56 and directs the twice filtered mud flow into the check valve 78 at the lower downstream end of the assembly.

It will be noted that the upstream portion of the annular passageway 48 that surrounds the aforementioned attenuator sidewall 516 and extends over the fine filter screen 316 has a narrower width dimension than the further downstream portion of the annular passageway 48 that is below the location of the second fine filter 316.

In FIG. 15A, only upstream and downstream end portions of the attenuator sidewall 518 are shown, and only rather short upstream and downstream portions of the attenuator chamber 76 are shown. It is be understood, however, in order for the attenuator chamber 76 to have sufficient volume to properly perform its function, the attenuator chamber 76 would extend for a substantial part of the overall length of assembly 10. For example, if the entire assembly 10 has an axial length of 10 to 40 feet, the attenuator chamber 76 could extend for possibly 20 to 40 percent of the total length.

The flow from the outlet check valve 80 leads through a passageway portion 524 and thence leads into the passageway 134. This passageway 524 also communicates directly with the attenuator chamber 76. The inlet and outlet check valves 78 and 80 are shown somewhat schematically, and these are mounted in a valve housing 526 which in turn is connected to a cylindrical member 528 which defines the upper ultra high pressure chamber 38. In the bottom right hand part of FIG. 15A, there is shown the upper end of the upper plunger 34. At the end of the plunger 34 there is a cylindrical washer 530 that has a recess to receive a nut 532 threaded onto the end of a rod 534 which extends through a central opening running the length of the plunger 34.

Figure 15B:
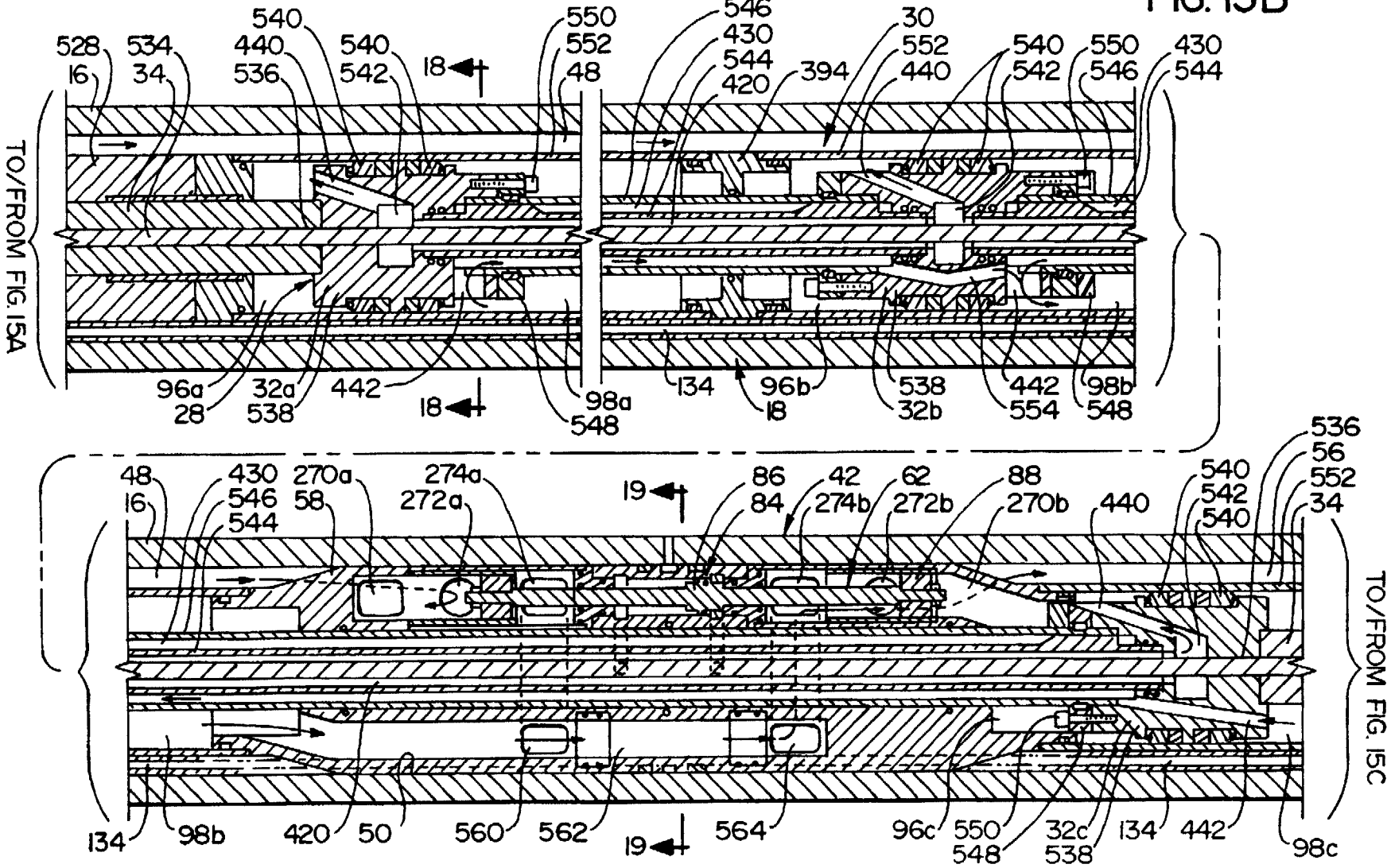

Reference is now made to the top left hand part of FIG. 15B, where there is shown the rest of the plunger 34. The rod 534 extends entirely through the main plunger structure 34, and through the entire piston assembly and through the opposite plunger 34 located at the other end of the piston assembly and has a threaded lower end at 536 which extends into the recess in the left hand washer 530. The nut 532 is threaded onto the end of the rod 534 with sufficient torque to place the main plunger structure 34 under compression loading against the piston **32*a***.

The piston **32*a* comprises a piston block 538 having at its outer cylindrical surface seal assemblies 540. The piston housing 538 is formed with a middle recess 542 that is at the upper end of the central passageway 420. Leading from this recess 542 are a plurality of the aforementioned passageways 440 that permit the drill mud to flow into and from the left hand chamber portion 96*a* immediately to the left of the piston 32*a*. Extending from the aforementioned piston recess 542, there is an interior cylindrical tube section 544 defining a portion of the inner passageway 420. Positioned concentrically around the inner tubular section 544 is an outer tube section 546, with the two tubular sections 544 and 546 defining therebetween a portion of the annular passageway 430. This outer cylindrical section 546 is connected at its left end to the piston housing 538 which is formed with an outlet passageway 442 for the flow of the drill mud into and out of the circumferential annular passageway 430. To fixedly connect the piston housing 538 to the outer tubular section 546, there is provided a retaining ring 548 which fits in a matching recess in the outer tubular section 546 and is connected by bolts 550 to the cylinder housing 538**.

Figure 18:
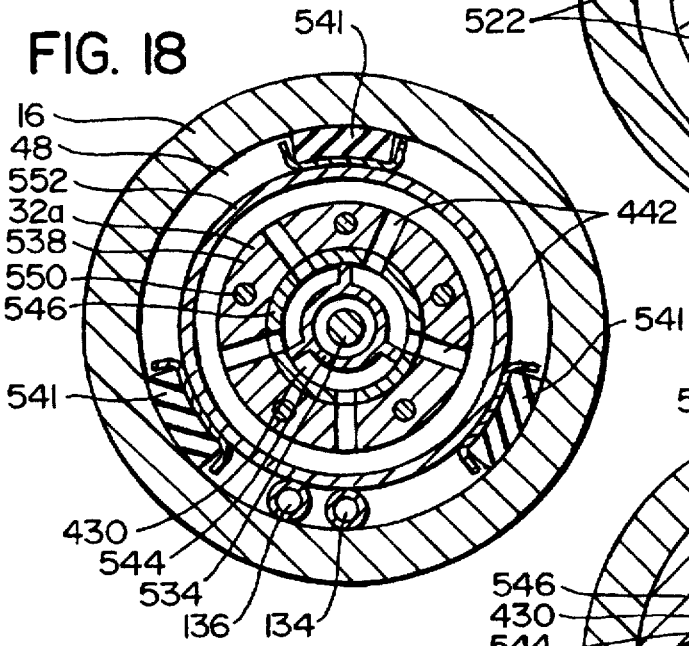
Figure 19:
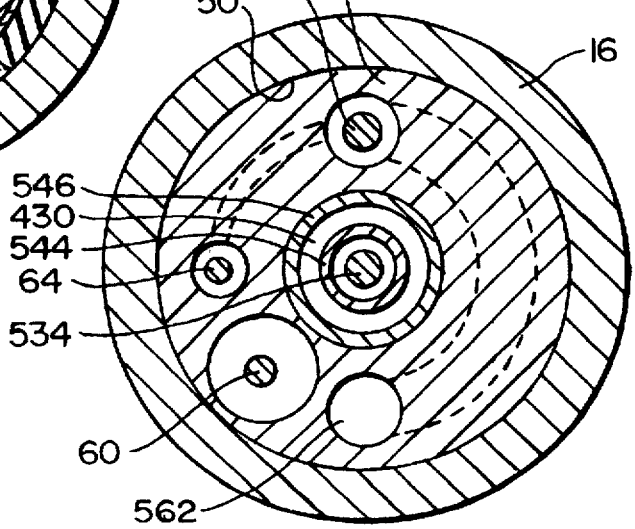

The pump intensifier housing 30 comprises the aforementioned plunger housing 528 and also comprises a cylindrical sidewall 552. At the right end of the sidewall 552 there is the stationary partition wall 394 having a circumferential cutout or recess to receive the lower end (right hand end as seen in FIG. 15B) of the cylindrical pump intensifier housing sidewall 552. As can be seen in FIG. 18, there are spacing members 541, made of a resilient material, positioned between the outer tubular housing 16 and the cylindrical sidewall 552 of the pump intensifier housing.

There is a similar cylindrical pump intensifier housing section 552 immediately to the right of the partition 394 (see top part of FIG. 15B). Positioned at the right of the partition wall 394 there is a second piston **32*b* which is constructed in generally the same manner as the piston 32*a*. However, the piston 32*b* does not connect to a plunger 34, but rather has upstream and downstream connections to related cylindrical members 544 and 546 both on the upstream side and the downstream side. It can be seen from viewing the right hand part of the upper section of FIG. 15B and the left hand part of the lower section of 15B that the next set of inner and outer cylindrical members 544 and 546 provide continuations of the central passageways 420 and 430 in a downstream direction. Also, the housing of the middle cylinder 32*b* has a through passageway 554 which connects the upstream and downstream annular passageway portions 430**.

Reference is now made to the lower part or section of FIG. 15B. It can be seen that at the left hand part of the lower section of FIG. 15B there is a continuation of the outer tubular housing 16, another cylindrical section of the pump intensifier housing 552, the outer central tubular member 546 and the inner tubular member 544, with these tubular members 546 and 544 defining the aforementioned central passageway 420, and the annular passageway 430. Also, the outer housing 16 and the pump intensifier housing 552 define another portion of the aforementioned upstream annular passageway 48.

At this point, with our description of the more detailed embodiment of the apparatus of the invention having been thus far described by presenting a description that proceeds through FIG. 15A and through the upper section of FIG. 15B, it may be helpful if we pause in this detailed description to identify briefly the main components which have been described thus far in this section with reference to FIG. 15A and through part of 15B and relate these back to the more simplified drawings of FIGS. 2–5.

First, in this detailed description, there have been identified the two plungers 34, and there has been a more detailed description of the left hand piston **32*a* (which is the upstream or the upper piston 32*a*), the middle piston 32*b*, and also the interconnecting tubular members 544 and 546 and rod 534 which define the inner annular flow passage 420 and the surrounding annular passage 430 which directs the pressurizing mud to the chambers on opposite sides of the pistons 32*a* and 32*b***.

To now relate these components back to the more simplified drawings of FIGS. 2–5, the inlet/outlet ports 440 formed in the pistons **32*a* and 32*b*, respectively, as shown in FIG. 15B, correspond to the inlet/outlet ports 100*a* and 100*b* shown in FIG. 2. The inlet/outlet ports 442 that are formed in the pistons 32*a* and 32*b* correspond to the inlet/outlet ports 104*a* and 104*b* shown in FIGS. 2–5. The innermost passageway 420 defined by the inner tube 544 corresponds to the passageway 102 in FIG. 2. The annular passageway 430 corresponds to the passageway 106** of FIG. 2.

Thus, it can be seen with reference to FIG. 15B that when the drill mud is flowing in an upstream direction in the passageway 420 to flow outwardly through the ports 440 in both of the pistons **32*a* and 32*b*, the two pistons 32*a*, 32*b* and 32*c* are being moved to the right, as seen in FIG. 15B (i.e. moved downwardly), as the drill mud is flowing into the two chambers 96*a* and 96*b* (and also the chamber 96*c*). At the same time, the drill mud in the chambers 98*a* and 98*b* is flowing out of those chambers and flowing through the ports 442 in the pistons 32*a* and 32*b* to flow downstream in the annular passageway 430 to be discharged through the control valve 62 into the downstream outer most annular flow passageway 56 and discharged through the drill bit assembly. (Later in this description the flow pattern relative to the third piston 32*c*** will be discussed.

Let us now turn our attention to the lower part of FIG. 15B which shows at the middle part thereof the valve section 42. As described previously, this valve section 42 has a valve housing 58 which fits against the inner surface 50 of the main housing 16 to form a seal at this surface 16. Also, this valve housing 58 provides a center-through opening to receive that portion of the connecting tubes 546 and 544 that extends between the pistons **32*b* and 32*c*. Further, the valve section 42 divides assembly 10** into an upstream portion and a downstream portion.

Figure 15C:
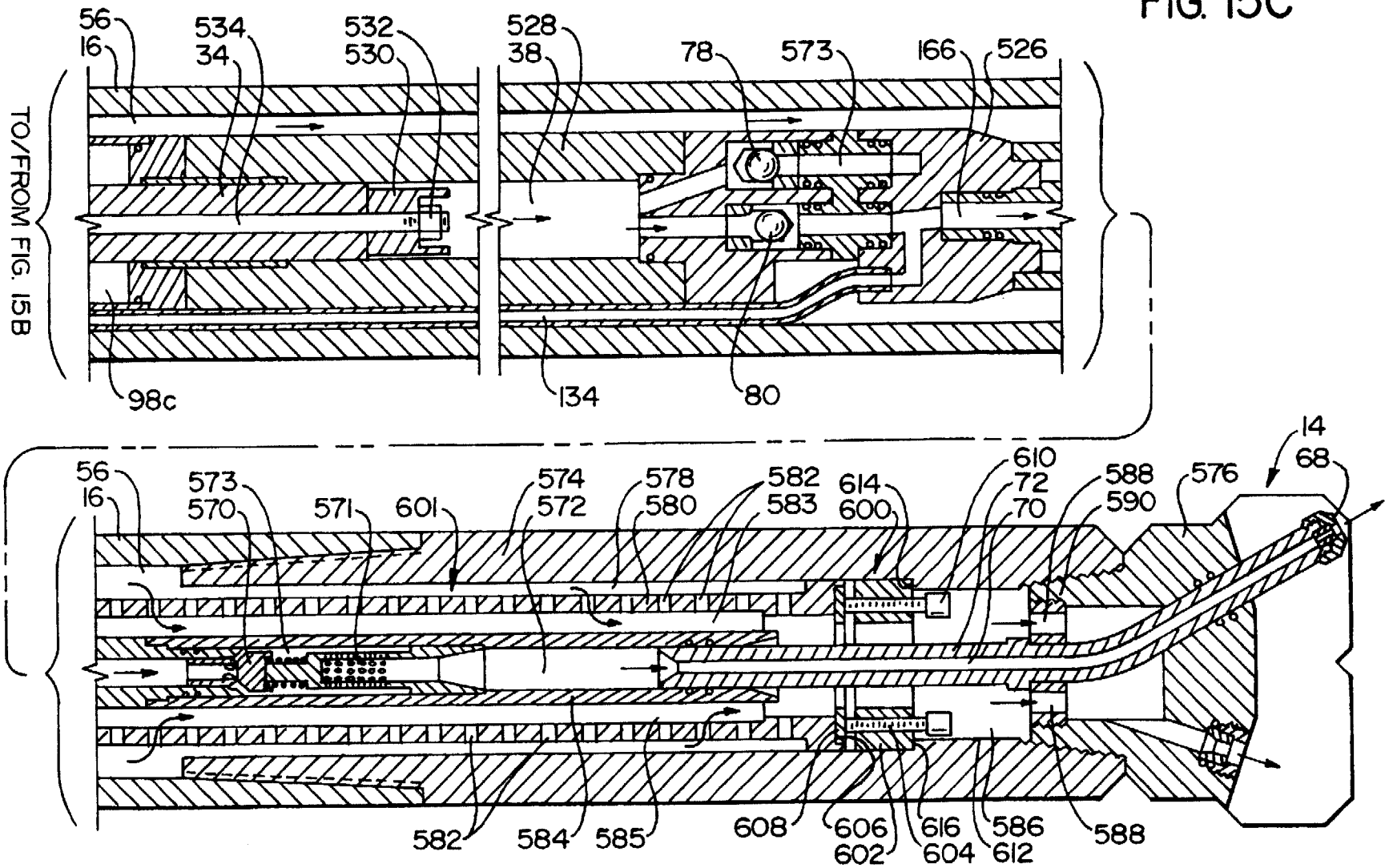
Figure 16:
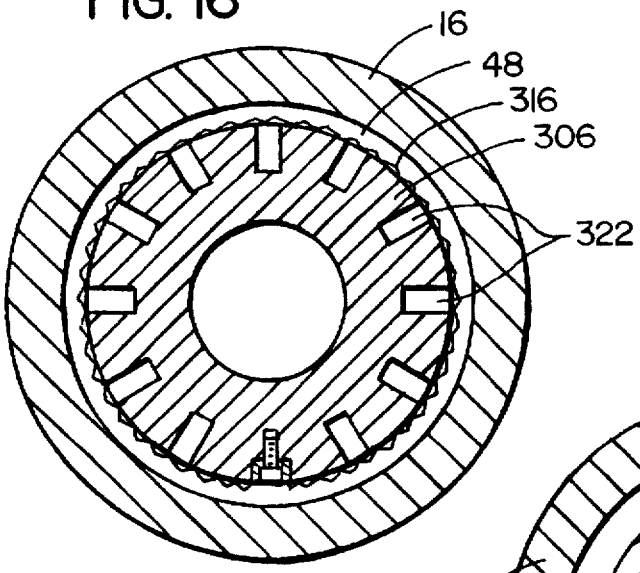
FIGS. 16, 17, 18 and 19 are sectional views taken at lines 16, 17, 18, and 19 of FIGS. 15A through 15C.
Figure 17:
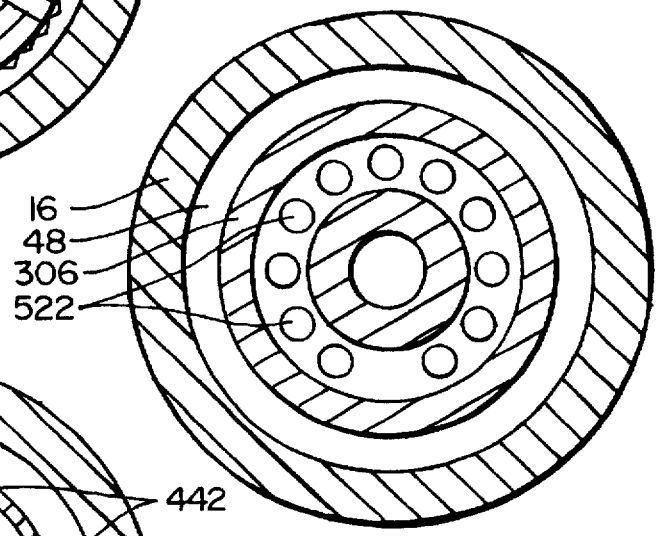

As described previously, there are three valves positioned in the valve housing 58 of this valve section 42 namely, the selector valve 60, the control valve 62, and the trigger valve 64. When the selector valve 60 is in the non-pumping position (achieved by having a lower volumetric flow rate of the drill mud through the annular passageway 48) the majority of the drill mud simply passes through the selector valve 60 into the downstream annular passageway 56 to be discharged from the drill bit assembly. When the volumetric flow is raised to a predetermined flow rate, the selector valve 60 is automatically moved to its pumping position to direct the mud traveling through the annular passageway 48 through the control valve to be directed in an alternating pattern to first flow into the left hand chambers **96*a*, 96*b*, and 96*c*, to move the piston assembly 28 downwardly (to the right as shown in FIGS. 15A–C), and then flowing into the downstream chambers 98*a*, 98*b* and 98*c* to move the piston assembly 28 upwardly (to the left as seen in FIGS. 15A–C). As described above, the trigger valve 64 causes the operation of the control valve 62**.

It is believed that the valve section 42 and the three valves 60, 62 and 64 have been described in sufficient detail earlier in this text so that further description is not required in this portion of the text. Only the control valve 62 is shown (in the embodiment of FIGS. 15A–C) in the lower part of FIG. 15B, and it can be seen that this is arranged in the same manner as shown in 12A, 12B and 12C. In the following text, only the flow paths of the ports **270*a* and *b*, 272*a* and *b* and 274*a* and *b*** will be described briefly.

It can be seen that the flow of once filtered mud through the outer annular passageway 48 flows initially through the port **272*a* into the left valve chamber and outwardly through the port 70*a*. This port 270*a* connects via port 270*a* to a passageway which extends through the valve section block 58 to open to the chamber 96*c* which is immediately between the valve section 42 and the right hand piston 32*c*. The downstream annular passageway 56 connects to port 272*b* which connects via port 274*b* through a passageway in the valve block 58 to an outlet port 564 that in turn connects to a passageway 562 that connects to the chamber portion 98*b*. Further, as discussed earlier, since the chambers 96*a*, *b* and *c* are all interconnected with one another through the middle passageway 420, the left surfaces of the pistons 32*a*, *b* and *c* are (in the position of FIGS. 15A–C) exposed to the higher pressure drill mud from the annular passageway 48 to move the piston assembly 28** to the right (as seen in FIG. 15B).

It will be noted that in the bottom part of FIG. 15B, the right hand passageway designated as **270*b* in FIG. 12A is formed by a passageway that opens directly to the chamber portion 96*c* and into the port 440 in the piston 32*c* which leads into the central passageway 420. Thus, in the position shown in FIG. 15B, the right spool 88 isolates the chamber portion 96*c* from the port 272*b* of the control valve 62. Then when the valve element 86 is shifted to the left so that the right spool 88 is moved to the left of the port 272*b*, the middle passageway 420 connects via ports 440 to the outlet port 272*b* to permit flow from the chambers 96*a*, 96*b* and 96*c* to exhaust into the downstream annular passageway 56, this occurring when the piston assembly 28** is moving to the left as seen in 15B.

With further reference to FIG. 15B, it can be seen that when the valve element 84 shifts to left from the position shown in FIG. 15B, the port **274*a* connects to the port 272*a* to cause the flow of higher pressure once filtered drill mud from the upper annular passageway 48 to flow through the port 272*a* into the port 274*a*, out through the port 560 and into the passageway 562 to flow into the chamber portion 98*b*. Part of the flow into the chamber 98*b* in turn flows through the port 442 in the middle piston 32*b* to flow into the annular passageway 430 and thence into the other chamber portions 98*a* and 98*c*. Also, the central chamber passageway 420, connecting with the passageways 440, passageway 270*b* and to the ports 272*b*, permits an outflow of the drill mud from the chambers 96*a*, 96*b* and 96*c* to the downstream annular passageway 56**.

Attention is now directed to FIG. 15C, with the top portion of FIG. 15C showing the downstream (i.e. lower) end of the piston assembly 28. There is a downstream valve housing 526 in which are positioned the aforementioned downstream inlet and outlet check valves 78 and 80, respectively. The high pressure outlet check valve 80 communicates with the passageway 166 which in turn leads through a check valve 570 into a passage 573, through a screen element 571 and into passageway portion 572, with this flow from the passageway 572 going through the passageway 70 defined by the tube 72 and out the one or more ultra high pressure jet nozzles 68.

The inlet check valve 78 connects to a passageway 573 which in turn connects to the aforementioned passageway 136 which directs the twice filtered lower pressure drill mud to the inlet check valve 78 (see FIG. 2). In the drawing of 15C, for convenience of illustration, the tube defining this passageway 136 is not shown.

The check valve 570 blocks any upstream flow through the high pressure nozzles 68. There is a problem that when the apparatus 10 is being lowered down the drill hole, there may be fluid pressure in the hole which would cause fluid, and also debris to travel upwardly through the inlet of the high pressure nozzle 68 and into the passageway 70, thus possibly clogging the passageway 70 or causing other problems. The check valve 570 effectively prevents this from occurring.

The filter 571 prevents debris from flowing into the passageway 572 and then to the ultra high pressure nozzle. For example, there may be some small metallic fragments that are loose in the apparatus, and these could be carried downstream. The filter 571 is sufficiently fine so this would stop any such fragments in passing down the passageway 78 and into the high pressure discharge nozzle 68.

With reference to the lower part of FIG. 15C, there is a cylindrical end section 574 which has a threaded connection to the lower end of the main outer housing 16. This lower end section 574 in turn has a threaded connection to a housing portion 576 of the drill bit assembly 14. This end section 574 defines the outer surface of an annular passageway 578 which connects to the downstream annular passageway 56. There is a cylindrical member 580 positioned within the end section 574 to form the inside surface of the annular passageway 578. This cylindrical member 580 has a plurality of through openings 582 which allow fluid to pass through member 580 into annular passage 583.

Surrounding the check valve 570 is an inner cylindrical section 584 that receives the ultra high pressure fluid from the passageway 166 and directs this into the aforementioned passageway 70. Between this cylindrical member 584 and the cylindrical member 580, there is an annular passageway 585 that receives the flow of drill mud through the openings 582 of the member 580, with the drill mud passing through the passageway portion 586 through openings 588 in an end positioning member 590 that locates the aforementioned ultra high pressure tube 72.

Positioned immediately downstream of the cylindrical member 580 and within the forward part of the outer housing end section 574, there is an axial load transmitting means 600.

The function of this axial loading means 600 is to place the entire inner housing structure (generally designated 601) in compression and to react the compression loads into the outer housing 16 as tension loads. In reviewing the overall structure of the apparatus 10, it can be seen that the outer housing 16 is a substantially continuous structure extending from the upstream end fitting 22 all the way to the drill bit assembly 14. The end section 574 which is threaded onto the downstream end of the outer housing 16 is, in a structural sense simply a downstream extension of the outer housing 16.

The inner housing 601 comprises the aforementioned pump housing 30 and various components which are positioned in axial alignment, both upstream and downstream, with the pump housing 30, and are structurally positioned relative to the pump housing 30 to accept these compressive loads. A review of FIG. 15A through 15C reveals that the inner housing 561 comprises the following structural elements beginning from the upstream end to the downstream end as follows: (a) the cylindrical housing member 518 (defining the attenuating chamber 76), (b) the filter housing 306, (c) the valve housing 526 (at the upstream end of the upstream high pressure chamber 38), (d) the cylindrical member 528 (defining the high pressure chamber 38), (e) the upper cylindrical side wall 542 (defining the upstream low pressure chamber), (f) the valve housing 58, (g) the downstream cylindrical side wall 552 (defining the downstream portion of the low pressure chamber), (h) the cylindrical member 528 (defining the downstream high pressure chamber 38), (i) the downstream valve housing 526, and (j) the cylindrical member 580.

The axial loading transmitting means 600 comprises an annular cylindrically shaped mounting block 602 having a plurality of longitudinally extending threaded through openings in which are mounted a plurality of bolts 604 which function as adjustable compression members. Between the bolts 604 and the forward downstream surface 606 of the cylindrical member 580, there is a disc-like annular bearing member 608. The bolts 604 are positioned in a circular (or circumferential) pattern in the block 602 at evenly spaced arcuate intervals within the mounting block 602, and the bolts 604 have downstream positioned bolt heads 610 which can be engaged by a wrench or other device to rotate the bolts to bear against the bearing member 608.

The forward part of the end section 574 is stepped radially inwardly as at 612 to provide an upstream facing annular shoulder surface 614 that engages a matching circumferential downstream facing surface portion 616 of the mounting block 602.

As indicated above, in terms of function, the outer end member 574 comprises the downstream end of the aforementioned outer housing 16. Thus, when the bolts 604 are threaded into their mounting block 602 to press against the bearing member 606, the mounting block 602 acts through its surface portion 616 to press against the shoulder surface 614 of the outer housing end section 574 to react the tension load in the outer housing 16. At the same time, the bearing member 608 presses against the downstream facing surface 606 of the cylindrical member 580 to place the entire inner housing 601 in compression.

To describe how this is accomplished, in the initial assembling of the drill bit assembly 10, prior to inserting the drill collar 576 in place, the bolts 604 are rotated to function as a jack screw and push the bearing member 608 away from the mounting block 602. Thus, the compression loads in the inner housing structure 601 extend all the way through the inner housing 601 to the upstream cylindrical housing member 518 which in turn reacts these into the upstream end of the outer housing 16.

This provides several benefits. First, there is a problem of vibration loads being reacted into the assembly 10. These vibration loads could result from operation of the pump, impact loading from the drill bit acting against the ground strata during the drilling operation, and possibly other factors. The G forces associated with these vibration loads can be at least two hundred times the mass of the components which are effected. This can cause leakage, wear, fretting, and other problems. The bolts 602 can be torqued down to exert sufficient compression loading to resist these vibration loads.

A further benefit from applying the axial loading to the inner housing 601 is that due to the high fluid pressures in the apparatus 10, there is tendency to urge the various components apart which also can cause leakage, fretting or other wear of the components. Further, with the cyclic loading of the high pressure fluid, the components are more prone to structural failure through fatigue. It has been found that in a preferred embodiment of the present invention (having a 6 ¾ inch diameter), a compressive force in the order of 170,000 pounds exerted against the inner housing 601 is sufficient to substantially alleviate the problems noted above.

It is believed that the operation of the embodiment shown in FIGS. 15A–C and also in FIGS. 16–19 is sufficiently clear from the description already given in this text. However, at this time, it may be helpful to give a brief overview of some of the main components in this embodiment as shown in FIGS. 15A–C (along with FIGS. 16–19) and relate these back to the relevant portions of the text.

To proceed through a brief summary of the assembly 10 shown in FIGS. 15A–C (and FIGS. 16–19), in FIG. 15A, it can be seen that there is a flow of drill mud through the passageway 502 into the upper end of the outer main tubular housing 16 and through the coarse filter screen 500. This once filtered drill mud then passes through the passageways 514 and into an outer annular passageway 48 which is defined by the outer tubular housing 16 and the attenuator sidewall 518. This attenuator sidewall 518 defines the attenuator chamber 76 which extends along a substantial length of the assembly 10.

With reference to the bottom half of FIG. 15A, the flow of once filtered drill mud proceeding downwardly through the annular passageway 48, passes by the fine filter screen 316. If the selector valve 60 is in its by-pass mode (non-pumping mode), there is reduced flow through this fine mesh filter 316. The majority of the drill mud from the upstream annular passageway 48 will flow down to the main valve section 42, through the selector valve 60 and thence directly into the main annular downstream chamber 56 to flow out the drill bit assembly 14. This drill mud will then serve a conventional purpose of flushing out the fragments and debris in the drill hole and moving this up the drill hole along the outside of the outer tubular housing 16 and along the outside of the main drill stem 12.

However, when the selector valve 60 is caused (by a higher volumetric flow of the once filtered drill mud as described earlier herein) to move into its operating mode, the selector valve 60 diverts all of the once filtered drill mud into the pressure intensifier system 18. This causes the piston assembly 28 to begin to reciprocate or reciprocate more rapidly, so that the ultra high pressure plunger 34 that is on its intake stroke draws drill mud through the fine mesh filter 316 (see FIG. 15A) and through the passageway 522 so that this twice filtered drill mud flows alternately into the upstream inlet check valve 78 and into the downstream inlet check valve 78 by passing through the passageway 136 (see FIGS. 2–5). Also, this twice filtered drill mud is directed through a passageway 130 to the trigger valve 64, and this once filtered drill mud passes from the trigger valve 64 to the control valve 62 to cause it to operate in its back and forth movement. This twice filtered drill mud discharge from the control valve 62 is directed back down to the trigger valve 64 and thence flows outwardly through the line 118. (See FIGS. 2–5).

Reference is now made to FIGS. 15B which shows the piston assembly in greater detail. To understand the overall operation of this piston assembly 28, it is recommended that the reader review Section 2 which makes reference to FIGS. 2–5 which show this piston assembly 28 in a simplified form from which the components and their operation are more easily understood. FIG. 15B is intended to show the actual structure of the piston assembly 28 and its associating component in more detail to give structural details more specifically of this embodiment.

With regard to the overall operation of the piston assembly 28, there are three larger pistons 32*a*, 32*b* and 32*c*. These are interconnected by a connecting rod 534 which together with concentric tubular rod portions 544 and 546 define central annular flow passageway 420 and a surrounding annular flow passageway 430. The central passageway 420 connects through ports 440 in each of the pistons 32*a*, *b* and *c* to the three left hand chamber portions 96*a*, 96*b* and 96*c*. The surrounding annular passageway 430 connects through the ports 442 in each of the pistons 32*a*, 32*b* and 32*c*, to the right hand piston portions 98*a*, 98*b* and 98*c*.

As indicated previously, if the drill mud 48 is at a lower volumetric flow, the selector valve 60 will remain in its by-pass mode so that the intensifier system 18 is partially by-passed. However, with a somewhat higher volumetric flow through the annular chamber 48, the selector valve 60 goes into its pumping mode and directs all of the once filtered drill mud that has passed by the fine mesh filter 316 into the control valve 62. The valve element 84 of the control valve 62 reciprocates back and forth to connect the drill mud from the upstream annular chamber 48 into either the chamber 98*b* that is immediately upstream of the main valve housing 58 or into the chamber 96*c* which is immediately downstream of the main valve housing 58. If the drill mud from the annular passageway 48 initially passes into the valve chamber 96*c*, it will immediately flow into the passageway 440 in the piston 32*c* into the central passageway 420 and outwardly through the ports 440 in the pistons 32*a* and 32*b* into the other two chamber portions 96*a* and 96*b*. Thus, the left side of all three pistons 32*a*, *b* and *c* will be pressurized to move the entire piston assembly 28 to the right.

At the same time, the drill mud that remains in the two chamber portions 98*a* and 98*c* will flow through the ports 442 (in the pistons 32*a* and 32*c*) and into the annular passageway 430 to flow through the port 442 in the middle piston 32*b* to pass into the chamber 98*b*, through the port 564, through the port 274*b*, out the port 272*b* and into the downstream annular passageway 56.

When the piston assembly reaches its end limit of travel, then the trigger valve 64 is activated to move to its other end position to move the valve element 84 of the control valve 60 to the opposite side and reverse the flow of the once filtered drill mud into and from the chambers 96*a*, *b* and *c*, and 98*a*, *b* and *c*. This causes the reciprocating motion of the piston assembly 28, that in turn causes the two plungers to alternately travel on their pressure strokes and intake strokes to force the ultra high pressure twice filtered drill mud to travel through the outlet check valves 80 in an alternating pattern to thus supply the ultra high pressure liquid to the ultra high pressure discharge nozzle or nozzles 68.

Reference is now made to FIG. 15C. It can be seen that there is a flow of once filtered drill mud through the outer annular passageway 56 which in turn passes into the downstream connector section 574 to move through into the passageway 578 and through the intercylindrical member 580 into passageway 585 then passes through the openings 588 to flow out the several flush nozzles 66 to remove fragments and debris from the drill hole and move the same upwardly around the assembly 10 and in the annular space between the drill stem 12 and the bore hole. At the same time, the ultra high pressure drill mud is passing into the passageway 166 to be directed through the check valve 570, into the passageway 70 and out the one or more ultra high pressure drill jet nozzles 68 to perform its cutting action and then flow upwardly with the main flow of drill mud around the assembly 10 and the drill stem 12.

It is to be recognized that various modifications could be made from the present invention without departing from the basic teachings thereof.

What is claimed:

1. A pump and drilling assembly for drilling into an earth formation, said assembly comprising:

a. an elongate housing structure having a longitudinal axis, an upstream end adapted to be connected to a drill string and to receive drill fluid therefrom, and a downstream end, said housing comprising a tubular outer housing and an inner housing positioned within said outer housing;

b. a drill bit assembly connected to the downstream end of the housing structure, said drill bit assembly having a high pressure fluid jet discharge means;

c. a pressure intensifier means positioned in the inner housing and comprising:

i. low pressure piston means mounted for reciprocating motion in low pressure chamber means within said inner housing;

ii. high pressure piston means connected to said low pressure piston means and mounted for reciprocating motion in high pressure chamber means within said inner housing;

d. a longitudinally extending main fluid passageway means having an inlet end to receive fluid flow of the drill fluid from said drill stem, and an outlet end at a downstream location, at least a portion of said main fluid passageway means being adjacent to said pressure intensifier means and positioned between said inner housing and said outer housing, said main fluid passageway means having an upstream passageway portion and a downstream passageway portion;

e. a valve section means positioned in said housing structure between said upstream and said downstream end, said valve section means comprising a control valve means to receive fluid flow from the upstream passageway portion and selectively direct said fluid flow to said low pressure chamber means to cause said low pressure piston means to reciprocate and cause said high pressure piston means to reciprocate, and to direct fluid from said low pressure chamber means to said downstream passageway portion;

f. pressure intensifier valve and passageway means arranged to direct low pressure drill fluid into said high pressure chamber means and to direct higher pressure drill fluid from said high pressure chamber means to said high pressure fluid jet discharge means.

2. The assembly as recited in claim 1, further comprising selector valve means operatively connected between said upstream passageway portion and said downstream passageway portion of said main fluid passageway means, said selector valve means having a first position where said drill fluid is permitted to pass from said upstream passageway portion of the main fluid passageway means to the downstream portion of the main fluid passageway means in a path by-passing said pressure intensifier means, and a second position where drill fluid from said upstream passageway portion is caused to flow through said control valve means and thence back to said downstream passageway portion to cause said pressure intensifier means to operate.

3. The assembly as recited in claim 2, wherein selector valve means is responsive to volumetric flow of said drill fluid thorough said upstream passageway portion to move between said first and second positions.

4. The assembly as recited in claim 3, wherein said selector valve means comprises means to define a by-pass passageway leading from said upstream passageway portion to said downstream passageway portion, and a selector valve element having a first position where said by-pass passageway is open, and a second position closing said by-pass passageway, spring means urging said selector valve element toward its first open position, said selector valve element being responsive to volumetric flow of the drill fluid form the upstream passageway portion to be urged against the spring means to move the selector valve element to the second position.

5. The assembly as recited in claim 3, wherein said selector valve means comprises a pressure relief mechanism responsive to a pressure in the drill fluid from the upstream passageway portion higher than a predetermined level to open said pressure relief mechanism to permit flow from said upstream passageway portion to said downstream passageway portion.

6. The assembly as recited in claim 1, wherein said low pressure piston means comprises first and second low pressure pistons, positioned in first and second low pressure chamber sections, respectively, with each low pressure piston separating its related chamber section into first and second chamber section portions, said valve section being positioned adjacent to said low pressure chamber means and having a first valve passageway leading from said control valve means to one of said first chamber section portions and a second valve passageway leading to one of said second chamber section portions, said control valve being arranged to direct fluid from said upstream passageway portion alternately to said first and second valve passageways and to withdraw fluid from said second and first chamber section portions alternately.

7. The assembly as recited in claim 6, wherein said valve section comprises a valve section housing positioned between said first and second low pressure pistons, said low pressure pistons being interconnected by a piston rod extending through said valve section housing and mounted in said valve section housing for reciprocating movement in sealing relationship with said valve section housing, said first valve passageway leading from said control valve means to one side of said valve section housing to communicate with said one of said first chamber section portions, and the second valve passageway leading from said control valve to an opposite side of said valve section housing to communicate with said one of said second chamber section portions.

8. The assembly as recited in claim 7, wherein said piston rod has first rod passageway means extending longitudinally therein and opening to both of said first chamber section portions, and second rod passageway means extending longitudinally in said piston rod and opening to both of said second chamber section portions.

9. The assembly as recited in claim 8, wherein said piston rod comprises a tubular inner rod member and a tubular outer rod member, said first rod passageway means being a passageway within said inner rod member, and said second rod passageway means being an annular passageway positioned between said inner rod member and said outer rod member.

10. The assembly as recited in claim 9, wherein said high pressure piston means comprises two high pressure pistons, and said two high pressure pistons, said two low pressure pistons, and said piston rod comprise a piston assembly, a tension rod means extending through said piston rod to said two high pressure pistons, means interconnecting with ends of said tension rod means to place a tension load on said tension rod means to apply a compressive load through said high pressure pistons and into said piston rod.

11. The assembly as recited in claim 8, comprising a third low pressure piston positioned in a third low pressure chamber section, said third low pressure piston being connected by a piston rod section to said second low pressure piston, said piston rod section having first and second additional rod passageway means interconnecting with the first and second rod passageway means of said piston rod, to cause first and second chamber section portions of said third piston to communicate with said first and second valve passageways.

12. The assembly as recited in claim 7, wherein said valve section further comprises pilot valve means operatively connected to said control valve means to direct fluid pressure against pressure control surface means of said control valve means to cause said control valve means to move between said first and second positions, said pilot valve means having actuating members positioned at first and second chamber section portions on opposite sides of said valve housing section, each of said actuating members being responsive to operative engagement by an adjacent one of said low pressure pistons in a manner that when the low pressure piston comes into operative engagement with its related actuating member, the pilot valve means moves to its other position, thus causing said pilot valve means to move said control valve means from one of its first and second positions to the other of said first and second positions.

13. The assembly as recited in claim 12, wherein said actuating members and said pilot valve means are arranged relative to said two low pressure pistons in a manner that when either of the two low pressure pistons engages one of the actuating member to shift the pilot valve means to its other position, the low pressure piston has not come into engagement with said valve section housing.

14. The assembly as recited in claim 7, wherein at least one of said upstream passageway portion and said downstream passageway portion of said main fluid passageway means comprises an annular passageway portion defined by said outer housing and said inner housing, said valve section housing having an outer housing portion blocking said annular passageway.

15. The assembly as recited in claim 14, wherein there is selector valve means operatively connected between said upstream passageway portion and said downstream passageway portion of said main fluid passageway means, said selector valve means having a first position where said drill fluid is permitted to pass from said upstream passageway portion of the main fluid passageway means to the downstream portion of the fluid passageway means in a path by-passing said pressure intensifier means, and a second position where drill fluid from said upstream passageway portion is caused to flow through said control valve means and thence to said downstream passageway portion to cause said pressure intensifier means to operate.

16. The assembly as recited in claim 7, wherein both of said upstream passageway portion and said downstream passageway portion of said main fluid passageway means comprise an annular passageway, said valve section housing having an outer housing portion separating said annular passageways from one another.

17. The assembly as recited in claim 16, wherein said valve section comprises selector valve means operatively connected between said upstream passageway portion and said downstream passageway portion of said main fluid passageway means, said selector valve means having a first position where said drill fluid is permitted to pass from said upstream passageway portion of the main fluid passageway means to the downstream portion of the main fluid passageway means in a path by-passing said pressure intensifier means, and a second position where drill fluid from said upstream passageway portion is caused to flow through said control valve means and thence to said downstream passageway portion to cause said pressure intensifier means to operate.

18. The assembly as recited in claim 1, wherein there is a filter means having a first filter surface located adjacent to said upstream passageway portion so as to be in contact with drill fluid in said upstream passageway portion, and a second surface adjacent to a filter chamber, said filter means being arranged so that drill fluid flowing into said inlet end of the main fluid passageway means has a portion thereof directed through said filter means into filter chamber, said pressure intensifier valve and passageway means comprising inlet passageway means leading from said filter chamber to inlet means of said high pressure piston means, whereby filtered drill fluid passes into said high pressure chamber means and is delivered to said high pressure fluid jet discharge means.

19. The assembly as recited in claim 18, wherein said control valve means has fluid pressure operating surface means, said control valve means having control fluid passageway means directing fluid from said filter chamber to said pressure operating surface means of the control valve means.

20. The assembly as recited in claim 19, wherein said valve section further comprise pilot valve means operatively connected to said control valve means, said pilot valve means directing fluid to said control valve means, said control valve passageway means interconnecting said filter chamber with said pilot valve means, with said pilot valve means interconnecting with the pressure operating surface means of the control valve.

21. The assembly as recited in claim 20, wherein said control valve means and said pilot valve means have discharge passageway means leading to a location outside of said outer housing, in a manner that drill fluid from said filter chamber that is directed to said control valve means and said pilot valve means is discharged to a location outside of said outer housing.

22. The assembly as recited in claim 18, wherein said filter means comprises a planar filter screen means having a substantial alignment component parallel to an adjacent flow path of drill fluid passing through said upstream passageway portion, so that drill fluid in said upstream passageway portion has a substantial flow path component parallel to said filter screen means, and so that the drill fluid passing adjacent to the filter screen means and through said upstream passageway portion removes filtered particles from said filter screen means.

23. The assembly as recited in claim 22 wherein a portion of said upstream passageway portion adjacent to said filter screen means is an annular passageway portion, and said filter screen means extends in a curved configuration inside of said annular passageway portion, whereby a portion of drill fluid passing through said annular passageway portion passes into said filter chamber.

24. The assembly as recited in claim 22 further comprising a second filter means positioned upstream of said filter means, said second filter means being a more coarse filter means and said filter means being a finer filter means.

25. The assembly as recited in claim 1, wherein said pressure intensifier means comprises a piston assembly, which comprises a low pressure piston section comprising a plurality of low pressure pistons, and two high pressure pistons on opposite ends of the low pressure piston section, a piston rod means interconnecting said low pressure pistons, a tension rod means having one end portion at one of said high pressure pistons and extending from said one of said high pressure pistons through the low pressure piston section to extend to the other of the high pressure pistons, said rod means having at opposite ends torquing means to place a tension load on said tension rod means with the tension rod means placing a compression load on said high pressure pistons and said piston rod means.

26. The assembly as recited in claim 25 wherein said tension rod means extends to an outer portion of each of said high pressure pistons, said torquing means comprising nut means on at least one end of said tension rod means.

27. The assembly as recited in claim 25 wherein said piston rod means comprises concentric tubular members defining inner and outer flow passageways for drill fluid, said tension rod means being positioned within said piston rod means.

28. The assembly as recited in claim 1, wherein said control valve means comprises:

a. a valve housing having a longitudinal axis and defining chamber means comprising an inlet first chamber section to receive fluid flow from said upstream passageway portion, and an outlet second chamber section to deliver fluid to said downstream passageway portion;

b. a longitudinally aligned valve element mounted for reciprocating movement in said chamber means;

c. said valve housing having at said first chamber section a first fluid inlet port and two first fluid outlet ports on opposite sides of said first fluid inlet port, said first fluid inlet port having a predetermined axial dimension;

d. said valve element having a first spool mounted in said first chamber section for reciprocating movement across said first fluid inlet port, said first spool member having an axial dimension less than the axial dimension of the first inlet port in a manner that when said first spool element is centrally positioned relative to said first inlet port, there is fluid flow from said first inlet port into both of said first outlet ports;

e. said valve housing having at said second chamber a second fluid outlet port and two second fluid inlet ports, on opposite sides of said second fluid outlet port, said second fluid outlet port having a predetermined axial dimension;

f. said valve element having a second spool element mounted for reciprocating motion in said second chamber section, said second spool element having an axial dimension less than the axial dimension of the second outlet port, in a manner that when said second spool element is centered in said second outlet port, said second outlet port communicates with both of said second inlet ports, whereby each of said spool elements has an intermediate position where fluid flow from the first inlet port is divided to the first two outlet ports, and fluid flow from the second inlet ports flows simultaneously through said second outlet port.

29. The assembly as recited in claim 28, wherein each of said first inlet port and said second outlet port has axial end portions having a transverse dimension which increases in a direction toward a center portion of said first inlet port and said second outlet port.

30. The assembly as recited in claim 1, wherein said pressure intensifier valve and passageway means comprises a passageway member defining a high pressure downstream passageway leading to said high pressure fluid jet discharge means, said assembly comprising check valve means positioned in said high pressure downstream passageway to prevent reverse flow entering into said high pressure fluid jet discharge means.

31. The assembly as recited in claim 30, wherein there is a filter operatively positioned in said high pressure downstream passageway to prevent particles or debris flowing into said high pressure downstream passageway and through the high pressure fluid jet discharge means.

32. The assembly as recited in claim 1, wherein there is a force transmitting means positioned at a downstream end of said inner housing and arranged to transmit a compression load in an upstream direction against said inner housing, to react a downstream load into a downstream end portion of said outer housing, whereby a compression load in the inner housing is reacted in an upstream direction into an upstream end of the outer housing.

33. The assembly as recited in claim 32, wherein said pressure intensifier means comprises a pressure intensifier housing defining said low pressure chamber means and said high pressure chamber means, said pressure intensifier housing comprising a portion of said inner housing, with other components of said inner housing being axially aligned with said pressure intensifier housing, and with said force transmitting means placing the pressure intensifier housing and the other components axially aligned therewith into compression loading.

34. The assembly as recited in claim 33, wherein said force transmitting means comprises a mounting block engaging said outer housing, and a bearing member engaging the downstream portion of the inner housing, said force transmitting means comprising axially adjustable force transmitting means which can be moved in an axial direction to press said bearing member from said mounting block and thus impart said compression load to said inner housing.

35. The assembly as recited in claim 34, wherein said mounting block comprises an annular block member, and said bearing member is an annular bearing member, said block member and said bearing member defining a portion of a through passageway through which drill fluid can pass to said drill bit assembly.

36. The assembly as recited in claim 32, wherein said drill bit assembly is removably mounted at a downstream end of said pump and drilling assembly, and said force transmitting means has axially adjustable force transmitting means, having adjustable head means at a downstream location in said force transmitting means, whereby said operating head means are accessible from a downstream location with said drill bit assembly removed.

37. The assembly as recited in claim 36, wherein said adjustable force transmitting means comprises a plurality of bolt means mounted in a mounting block operatively connected to said outer housing, and said bolt means having downstream positioned bolt head means which can be engaged to move said bolt means axially against said bearing member.

38. The assembly as recited in claim 1, wherein at least one of said upstream passageway portion and said downstream passageway portion of said main fluid passageway means comprises an annular passageway portion defined by said outer housing and said inner housing.

39. The assembly as recited in claim 1, wherein both of said upstream passageway portion and said downstream passageway portion of said main fluid passageway means comprises an annular passageway portion.

40. A method of high pressure jet assisted drilling into an earth formation, said method comprising:

a. providing an elongate housing structure having a longitudinal axis, an upstream end and a downstream end, said housing comprising a tubular outer housing and an inner housing positioned within said outer housing;

b. connecting the upstream end of the housing structure to receive drill fluid therefrom, c. connecting a drill bit assembly to the downstream end of the housing structure, said drill bit assembly having a high pressure fluid jet discharge means;

d. positioning a pressure intensifier means positioned in the inner housing, with said pressure intensifier means comprising:

i. low pressure piston means mounted for reciprocating motion in low pressure chamber means within said inner housing;

ii. high pressure piston means connected to said low pressure piston means and mounted for reciprocating motion in high pressure chamber means within said inner housing;

e. directing drill fluid from said drill stem into a longitudinally extending main fluid passageway means having an inlet end to receive fluid flow of the drill fluid from said drill stem, and an outlet end at a downstream location, at least a portion of said main fluid passageway means being adjacent to said pressure intensifier means and positioned between said inner housing and said outer housing, said main fluid passageway means having an upstream passageway portion and a downstream passageway portion;

f. positioning a valve section means in said housing structure between said upstream and said downstream end, said valve section means comprising a control valve means;

g. directing fluid flow from the upstream passageway portion to said control means and selectively directing said fluid flow to said low pressure chamber means to cause said low pressure piston means to reciprocate and cause said high pressure piston means to reciprocate, and directing fluid from said low pressure chamber means to said downstream passageway portion;

h. directing low pressure drill fluid into said high pressure chamber means and directing higher pressure drill fluid from said high pressure chamber means to said high pressure fluid jet discharge means.

* * * * *